US010048625B2

(12) United States Patent
Ohta et al.

(10) Patent No.: US 10,048,625 B2
(45) Date of Patent: Aug. 14, 2018

(54) IMAGE FORMING APPARATUS WITH CONTROL OF PRIMARY TRANSFER VOLTAGE

(71) Applicant: CANON KABUSHIKI KAISHA, Tokyo (JP)

(72) Inventors: Tetsuya Ohta, Abiko (JP); Tohru Nakaegawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/592,666

(22) Filed: May 11, 2017

(65) Prior Publication Data

US 2017/0336738 A1 Nov. 23, 2017

(30) Foreign Application Priority Data

May 18, 2016 (JP) ..... 2016-099854
Mar. 2, 2017 (JP) ..... 2017-039692

(51) Int. Cl.
*G03G 15/16* (2006.01)

(52) U.S. Cl.
CPC ..... *G03G 15/1665* (2013.01)

(58) Field of Classification Search
CPC ..... G03G 15/1665
USPC ..... 399/66
See application file for complete search history.

(56) References Cited

U.S. PATENT DOCUMENTS 6,477,339 B1 * 11/2002 Yano ..... G03G 15/0131 399/302
7,865,097 B2 1/2011 Ishikawa
8,068,756 B2 11/2011 Ishikawa
9,454,109 B2 9/2016 Kojima et al.
2007/0242967 A1 10/2007 Hano et al.
2011/0110677 A1 5/2011 Uehara
(Continued)

FOREIGN PATENT DOCUMENTS

EP 1 355 203 A2 10/2003
JP 11272093 A * 10/1999
JP 2005-164779 A 6/2005
JP 2007-057853 A 3/2007
(Continued)

OTHER PUBLICATIONS

Extended European Search Report dated Oct. 13, 2017, in European Patent Application No. 17169409.4.

*Primary Examiner* — Susan Lee
(74) *Attorney, Agent, or Firm* — Fitzpatrick, Cella, Harper & Scinto

(57) ABSTRACT

An image forming apparatus includes an image bearing member, an intermediary transfer belt, a primary transfer roller provided so that a contact region between the roller and the belt and a contact region between the image bearing member and the belt are in a non-overlapping state with each other with respect to a movement direction of the belt, a primary transfer voltage source, a current detecting portion, an executing portion configured to acquire information on a discharge start voltage on the basis of a detection result of the detecting portion in a period other than a period of primary transfer by applying the voltage to the roller and a setting portion configured to set, on the basis of an execution result of the executing portion, a primary transfer voltage applied to the roller by the primary transfer voltage source in the period of the primary transfer.

14 Claims, 18 Drawing Sheets

(56) References Cited

U.S. PATENT DOCUMENTS

| | | | | |
|---|---|---|---|---|
| 2014/0169816 | A1* | 6/2014 | Hashii | G03G 15/043 399/51 |
| 2014/0270864 | A1 | 9/2014 | Yashiro et al. | |
| 2014/0321891 | A1 | 10/2014 | Karashima et al. | |
| 2015/0338791 | A1* | 11/2015 | Matsushita | G03G 15/1615 399/66 |
| 2016/0124353 | A1 | 5/2016 | Nakaegawa | |
| 2016/0274502 | A1* | 9/2016 | Honda | G03G 15/1605 |
| 2017/0060045 | A1 | 3/2017 | Nakaegawa | |

FOREIGN PATENT DOCUMENTS

| | | | | | |
|---|---|---|---|---|---|
| JP | 2008-020661 | A | | 1/2008 | |
| JP | 2009-042399 | A | | 2/2009 | |
| JP | 2012022035 | A | * | 2/2012 | |
| JP | 2012237837 | A | * | 12/2012 | G03G 15/0131 |

* cited by examiner (a)

(b)

IMAGE FORMING APPARATUS WITH CONTROL OF PRIMARY TRANSFER VOLTAGE

FIELD OF THE INVENTION AND RELATED ART

The present invention relates to an image forming apparatus, such as a copying machine, a printer or a facsimile machine, of an electrophotographic type or an electrostatic recording type.

As a conventional image forming apparatus of, e.g., an electrophotographic type, an image forming apparatus of an intermediary transfer type in which a toner image formed on a photosensitive member as an image bearing member is primary-transferred onto an intermediary transfer member and then is secondary-transferred onto a recording material such as paper has been known. Primary transfer is carried out by supplying a primary transfer current to a primary transfer portion where the photosensitive member and the intermediary transfer member are in contact with each other. In general, the primary transfer current is supplied by applying a primary transfer voltage (primary transfer bias) to the primary transfer portion through a primary transfer roller as a primary transfer member provided opposed to the photosensitive member via an intermediary transfer belt (member). As the intermediary transfer member, an endless belt formed of a material such that electroconductive particles such as carbon black are dispersed in a thermoplastic resin material or a thermosetting resin material and thus an electric resistance is adjusted, i.e., the intermediary transfer belt is used in many cases.

When a printing operation is repetitively performed using the intermediary transfer belt as described above, a surface resistivity of the intermediary transfer belt gradually lowers in some cases. This would be considered due to the following reason. That is, in a transfer step, the electroconductive particles at the surface of the intermediary transfer belt are electrically charged, and an electric field locally generates between these electroconductive particles and other electroconductive particles existing in the neighborhood of these electroconductive particles. In the case where this electric field is strong, electric discharge generates between these two electroconductive particles, so that a resin portion sandwiched between the electroconductive particles is subjected to heat by the electric discharge and thus is decomposed and carbonized. The carbonized resin portion loses an insulating property and becomes an electroconductor. It would be considered that such dielectric breakdown in a local region gradually enlarges during repetition of the transfer step, and thus the surface resistivity of the intermediary transfer belt lowers.

Here, due to a difference in surface resistivity of the intermediary transfer belt, a primary transfer efficiency largely changes. In the case where the surface resistivity of the intermediary transfer belt is low, a field intensity in the primary transfer portion becomes strong for a primary transfer current. On the other hand, in the case where the surface resistivity of the intermediary transfer belt is high, the field intensity in the primary transfer portion becomes weak for the same primary transfer current. For that reason, as shown in FIG. 14, when a value of the primary transfer current is increased so as to increase a primary transfer efficiency, in the case where the surface resistivity of the intermediary transfer belt is low, a lowering in re-transfer efficiency is conspicuous from a smaller value of the primary transfer current compared with the case where the surface resistivity of the intermediary transfer belt is high. Incidentally, in FIG. 14, the primary transfer efficiency is represented by a proportion of a toner amount of a toner image transferred on the intermediary transfer belt to a toner amount of the toner image formed on the photosensitive member. Further, the re-transfer efficiency is represented by a proportion of a toner amount of the toner image remaining on the intermediary transfer belt without being re-transferred (transferred back) to the photosensitive member to a toner amount of the toner image temporarily transferred on the intermediary transfer belt. The re-transfer is caused by charging the toner on the intermediary transfer belt to an opposite polarity to a normal charge polarity by electric discharge at the primary transfer portion.

In FIG. 14, a solid arrow represents an optimum primary transfer current (value) at a low result of the intermediary transfer belt ("LROV") and a dotted arrow represents an optimum primary transfer current (value) at a high result of the intermediary transfer belt ("HROV"), from viewpoints of the primary transfer efficiency and the re-transfer efficiency. Thus, when the surface resistivity lowers, the optimum primary transfer current becomes small. In order to realize a good transfer property and suppress an amount of toner consumption, it is desired that a primary transfer voltage depending on the surface resistivity of the intermediary transfer belt is applied to the primary transfer portion so that the primary transfer current depending on the surface resistivity of the intermediary transfer belt can be supplied to the primary transfer portion.

Therefore, in the case where a fluctuation in surface resistivity of the intermediary transfer belt during manufacturing and a gradual lowering in surface resistivity of the intermediary transfer belt during repetition of a printing operation are taken into consideration, it is required that the surface resistivity of the intermediary transfer belt is measured in the image forming apparatus. Japanese Laid-Open Patent Application (JP-A) 2008-20661 proposes a method in which discharge light generating from an end portion of a transfer roller during transfer is detected using a see-through intermediary transfer belt and a transfer roller including an optically anisotropic material and thus an electric resistance characteristic of the intermediary transfer belt is checked.

However, in the method of JP-A 2008-20661, as materials of the intermediary transfer belt and the transfer roller, materials having special optical characteristics are required to be used, so that constraints of the materials are large. Further, the transfer roller is provided with a discharge light detecting means at the end portion thereof, so that a cost thereof increases.

Therefore, in the case where a metal-made primary transfer roller including no elastic layer at an outer periphery thereof is used as a primary transfer member, a method in which an electric resistance characteristic of the intermediary transfer belt is known by, for example, measuring a voltage when a predetermined primary transfer current equal to that during a primary transfer step is caused to flow would be considered. When the voltage is applied to the primary transfer roller, the current flows through the primary transfer portion via the intermediary transfer belt, and therefore, it is possible to indirectly know the electric resistance characteristic of the intermediary transfer belt. However, in this method, when a position (distance) of the primary transfer roller relative to the photosensitive member with respect to a movement direction of the intermediary transfer belt changes, it is difficult to accurately know the electric resistance characteristic of the intermediary transfer belt.

FIG. 15 shows a relationship between the voltage applied to the primary transfer roller and the current flowing through the primary transfer portion in the case where the surface resistivity of the intermediary transfer belt or the distance of the primary transfer roller from the primary transfer portion changes. In the case where the distance of the primary transfer roller from the primary transfer portion is the same, it is possible to know the electric resistance characteristic from a magnitude of the voltage when a predetermined current is caused to flow (curves of a chain line and a broken line in FIG. 15). However, when the positions of the primary transfer roller change, there arises a difference in distance of passing of the intermediary transfer belt until the current flows through the primary transfer portion. Further, the position of the primary transfer roller generally fluctuates within a certain tolerance. For that reason, when the voltage at which a predetermined current flows is applied, it is difficult to accurately know the electric resistance characteristic of the intermediary transfer belt from the applied voltage (curves of a solid line and the broken line in FIG. 15).

SUMMARY OF THE INVENTION

According to an aspect of the present invention, there is provided an image forming apparatus comprising: an image bearing member configured to bear a toner image; an intermediary transfer belt configured to temporarily carry the toner image which is primary-transferred from the image bearing member at a primary transfer portion and which is then to be secondary-transferred onto a recording material; a primary transfer roller configured to form the primary transfer portion in contact with the intermediary transfer belt, the primary transfer belt being provided so that a contact region between the primary transfer roller and the intermediary transfer belt and a contact region between the image bearing member and the intermediary transfer belt are in a non-overlapping state with each other with respect to a movement direction of the intermediary transfer belt; a primary transfer voltage source configured to apply a voltage to the primary transfer roller; a detecting portion configured to detect a current flowing through the primary transfer portion; an executing portion configured to acquire information on a discharge start voltage on the basis of a detection result of the detecting portion in a period other than a period of primary transfer by applying the voltage to the primary transfer roller by said primary transfer voltage source; and a setting portion configured to set, on the basis of an execution result of the executing portion, a primary transfer voltage applied to the primary transfer roller by the primary transfer voltage source in the period of the primary transfer.

According to another aspect of the present invention, there is provided an image forming apparatus comprising: an image bearing member configured to bear a toner image; an intermediary transfer belt configured to temporarily carry the toner image which is primary-transferred from the image bearing member at a primary transfer portion and which is then to be secondary-transferred onto a recording material; a primary transfer roller configured to form the primary transfer portion in contact with the intermediary transfer belt, the primary transfer belt being provided so that a contact region between the primary transfer roller and the intermediary transfer belt and a contact region between the image bearing member and the intermediary transfer belt are in a non-overlapping state with each other with respect to a movement direction of the intermediary transfer belt; a primary transfer voltage source configured to apply a voltage to the primary transfer roller; a detecting portion configured to detect a current flowing through the primary transfer portion; a secondary transfer voltage source configured to apply a voltage to the secondary transfer portion; an executing portion configured to acquire information on a discharge start voltage on the basis of a detection result of the detecting portion in a period other than a period of primary transfer by applying the voltage to the primary transfer roller by said primary transfer voltage source; and a changing portion configured to change, on the basis of an execution result of the executing portion, an upper limit of a secondary transfer voltage applied to the secondary transfer portion by the secondary transfer voltage source in a period of secondary transfer.

According to a further aspect of the present invention, there is provided an image forming apparatus comprising: an image bearing member configured to bear a toner image; an intermediary transfer belt configured to temporarily carry the toner image which is primary-transferred from the image bearing member at a primary transfer portion and which is then to be secondary-transferred onto a recording material; a primary transfer roller configured to form the primary transfer portion in contact with the intermediary transfer belt, the primary transfer belt being provided so that a contact region between the primary transfer roller and the intermediary transfer belt and a contact region between the image bearing member and the intermediary transfer belt are in a non-overlapping state with each other with respect to a movement direction of the intermediary transfer belt; a primary transfer voltage source configured to apply a voltage to the primary transfer roller; a detecting portion configured to detect a current flowing through the primary transfer portion; a feeding member configured to feed the recording material to the secondary transfer portion; an executing portion configured to acquire information on a discharge start voltage on the basis of a detection result of the detecting portion in a period other than a period of primary transfer by applying the voltage to the primary transfer roller by said primary transfer voltage source; and a changing portion configured to change, on the basis of an execution result of the executing portion, a feeding speed of the recording material fed to the secondary transfer portion by the feeding member.

Further features of the present invention will become apparent from the following description of exemplary embodiments with reference to the attached drawings.

DESCRIPTION OF EMBODIMENTS

An image forming apparatus according to the present invention will be described specifically with reference to the drawings.

Embodiment 1

1. General Constitution and Operation of Image Forming Apparatus

Figure 1:
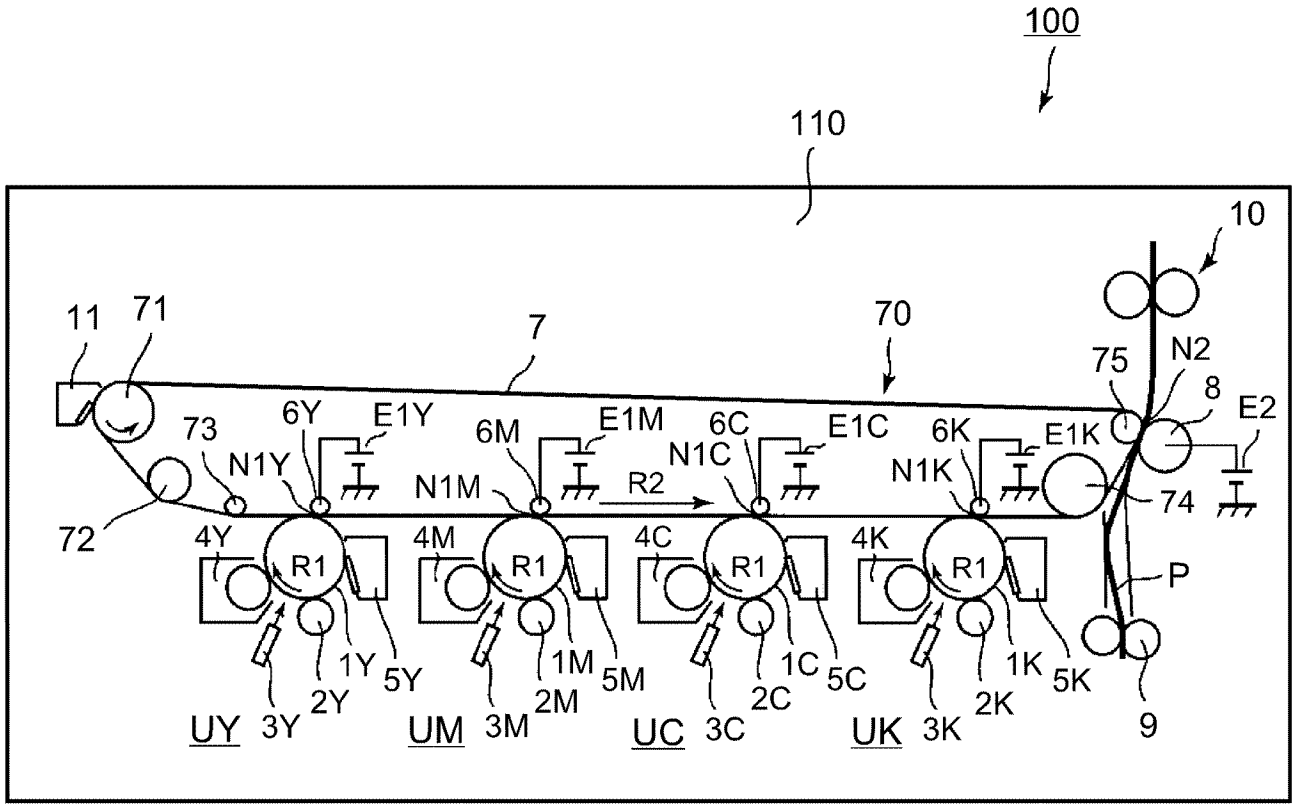
FIG. 1 is a schematic sectional view of an image forming apparatus.

FIG. 1 is a schematic sectional view of an image forming apparatus 100 in this embodiment according to the present invention.

The image forming apparatus 100 in this embodiment is a tandem image forming apparatus capable of forming a full-color image using an electrophotographic type and an intermediary transfer type.

The image forming apparatus 100 includes first to fourth image forming units UY, UM, UC and UK for forming images of yellow (Y), magenta (M), cyan (C) and black (K), respectively. Incidentally, elements which are provided for the respective colors and which have the same or corresponding functions or constitutions are collectively described in some instances by omitting suffixes Y, M, C and K for representing the elements for associated colors. In this embodiment, the image forming unit is constituted by including a photosensitive member 1 described later, a charging roller 2, an exposure device 3, a developing device 4, and a photosensitive member cleaning direction 5.

A drum-type photosensitive member (photosensitive drum) 1 as an image bearing member is rotationally driven in an indicated arrow R1 direction (clockwise direction). A surface of the rotating photosensitive member 1 is electrically charged to a predetermined polarity (negative in this embodiment) and a predetermined potential by the charging roller 2. The charged surface of the photosensitive member 1 is subjected to scanning exposure depending on image information by the exposure device 3, so that on the photosensitive member 1, an electrostatic latent image (electrostatic image) is formed. The electrostatic latent image formed on the photosensitive member 1 is developed (visualized) with a toner as a developer by the developing device 4 as a developing means. In this embodiment, the toner charged to the same polarity (negative in this embodiment) as the charge polarity of the photosensitive member 1 is deposited on an exposed portion of the photosensitive member 1 lowered in absolute value of the potential by the exposure to light after the photosensitive member 1 is uniformly charged. In this embodiment, when development is not carried out, the developing device 4 is appropriately spaced from the photosensitive member 1.

An intermediary transfer belt 7 constituted by an endless belt as an intermediary transfer member is provided so as to oppose all of the photosensitive members 1. The intermediary transfer belt 7 is extended and stretched with predetermined tension by, as a plurality of stretching rollers, a driving roller 71, a tension roller 72, first and second idler rollers 73 and 74, and a secondary transfer opposite roller 75. In an inner peripheral surface side of the intermediary transfer belt 7, primary transfer rollers 6 which are roller-type primary transfer members as primary transfer means are provided correspondingly to the respective photosensitive members 1. Each primary transfer roller 6 urges the intermediary transfer belt 7 toward the associated photosensitive member 1 and forms a primary transfer portion (primary transfer nip) N1 where the photosensitive member 1 and the intermediary transfer belt 7 are in contact with each other. The intermediary transfer belt 7 is an example of the intermediary transfer member for feeding the toner image, primary-transferred from the photosensitive member 1 at the primary transfer portion N1, so as to be secondary-transferred onto the recording material P at a secondary transfer nip N2. Further, the primary transfer roller 6 is an example of a primary transfer member contacting a surface of the intermediary transfer belt 7 opposite from a surface, of the intermediary transfer belt 7, where the photosensitive member 1 contacts the intermediary transfer belt 7.

As described above, the toner image formed on the photosensitive member 1 is transferred (primary-transferred), at the primary transfer portion N1, onto the intermediary transfer belt 7 rotating in an arrow R1 direction in FIG. 1 by the action of the primary transfer roller 6. During a primary transfer step, to the primary transfer roller 6, a primary transfer voltage (primary transfer bias) which is a DC voltage of an opposite polarity to the charge polarity (normal charge polarity) during the development is applied from a primary transfer voltage source E1. For example, during full-color image formation, the toner images of the respective colors of yellow, magenta, cyan and black formed on the respective photosensitive members 1 are successively transferred superposedly onto the intermediary transfer belt 7 at the respective primary transfer portions N1.

In an outer peripheral surface side of the intermediary transfer belt 7, at a position opposing the secondary transfer opposite roller (inner secondary transfer roller) 75, a secondary transfer roller (outer secondary transfer roller) 8 which is a roller-type secondary transfer member as a secondary transfer means is provided. The secondary transfer roller 8 is urged toward the secondary transfer opposite roller 75 via the intermediary transfer belt 7, and forms a secondary transfer portion (secondary transfer nip) N2 where the intermediary transfer belt 7 and the secondary transfer roller 8 are in contact with each other.

The toner images formed on the intermediary transfer belt 7 as described above are transferred (secondary-transferred), at the secondary transfer portion N1, onto the recording material P such as paper sandwiched and fed by the intermediary transfer belt 7 and the secondary transfer roller 8 by the action of the secondary transfer roller 8. During a secondary transfer step, to the secondary transfer roller 8, a secondary transfer voltage (secondary transfer bias) which is a DC voltage of an opposite polarity to the normal charge polarity of the toner is applied from a secondary transfer voltage source E2. The recording material P is accommodated in a tray (not shown) and is fed from the tray by a pick-up roller (not shown) to a registration roller pair 9 consisting of first and second registration rollers 9*a* and 9*b*. Then, the recording material P is supplied to the secondary transfer portion N2 while being timed to the toner images on the intermediary transfer belt 7 by the registration roller pair 9.

The recording material P on which the toner images are transferred is fed to a heat-fixing device 10 as a fixing means and is heated and pressed by this heat-fixing device 10, so that the toner image is fixed (melt-fixed) and thereafter is discharged (outputted) to an outside of an apparatus main assembly 110 of the image forming apparatus 100.

On the other hand, the toner (primary transfer residual toner) remaining on the surface of the photosensitive member 1 after the primary transfer step is removed and collected from the surface of the photosensitive member 1 by a photosensitive member cleaning device 5 as a photosensitive member cleaning means. Further, in the outer peripheral surface side of the intermediary transfer belt 7, at a position opposing the driving roller 71, a belt cleaning device 11 as an intermediary transfer member cleaning means is provided. The toner (secondary transfer residual toner) and paper dust which remain on the surface of the intermediary transfer belt 7 after the secondary transfer step are removed and collected from the surface of the intermediary transfer belt 7 by a belt cleaning device 11.

2. Constitution Relating to Transfer

Next, a constitution relating to the transfer in this embodiment will be described specifically.

As the intermediary transfer belt 7, a belt formed of a material in which an electroconductive filler (electron-conductive material) such as carbon black or an ion-conductive material is contained and dispersed in an appropriate amount in a resin material such as polyimide or polyamide or various rubbers is suitably used. In this embodiment, the intermediary transfer belt 7 is formed of a material in which carbon black is dispersed in a polyimide resin material and has electron conductivity. The intermediary transfer belt 7 having the electron conductivity has a feature such that a surface resistivity is not readily fluctuated depending on a fluctuation in environment. An electric resistance characteristic of the intermediary transfer belt 7 is adjusted so that the surface resistivity of the intermediary transfer belt 7 is $1\times10^{9}$-$5\times10^{12}$ Ω/□ (square). Further, the intermediary transfer belt 7 is formed in a film shape of, e.g., 0.04-0.5 mm in thickness.

In this embodiment, the intermediary transfer belt 7 is stretched by, as stretching rollers, the driving roller 71, the tension roller 72, the first and second idler rollers 73 and 74, and the secondary transfer opposite roller 75, and is circulated and driven (rotated) at a predetermined speed. The driving roller 71 is driven by a motor, as a driving means, excellent in constant-speed property and circulates and drives the intermediary transfer belt 7. The first and second idler rollers 73 and 74 support the surface (primary transfer surface) of the intermediary transfer belt 7 extending along an arrangement direction of the respective photosensitive members 1. The tension roller 72 imparts certain tension to the intermediary transfer belt 7. In this embodiment, the tension imparted to the intermediary transfer belt 7 by the tension roller 72 is about 3-12 kgf. The secondary transfer opposite roller 74 sandwiches the intermediary transfer belt 7 between itself and the secondary transfer roller 8 and forms the secondary transfer portion N2. In this embodiment, the secondary transfer opposite roller 75 includes an elastic layer (rubber layer) formed of an EPDM rubber and is 20 mm in outer diameter, 0.5 mm in thickness of the rubber layer and is, e.g., 70° in hardness (ASKER-C hardness). In this embodiment, the secondary transfer roller 8 includes an elastic layer formed of an NBR rubber, an EPDM rubber or the like on a core metal and is 24 mm in outer diameter. To the secondary transfer roller 8, the secondary transfer voltage source E2 is connected, and a secondary transfer voltage applied from the secondary transfer voltage source E2 to the secondary transfer roller 8 is variable.

In this embodiment, the primary transfer roller 6 is constituted by a metal-made roller (metal roller). As a material of this metal roller, SUM or SUS is suitably used. In this embodiment, the primary transfer roller 6 is substantially constant in outer diameter with respect to a rotational axis direction (thrust direction) and has a straight shape. The outer diameter of the primary transfer roller 6 may suitably be about 6-10 mm, and is 8 mm in this embodiment. To the primary transfer roller 6, the primary transfer voltage source E1 is connected, and the primary transfer voltage applied from the primary transfer voltage source E1 to the primary transfer roller 6 is variable.

Figure 2:
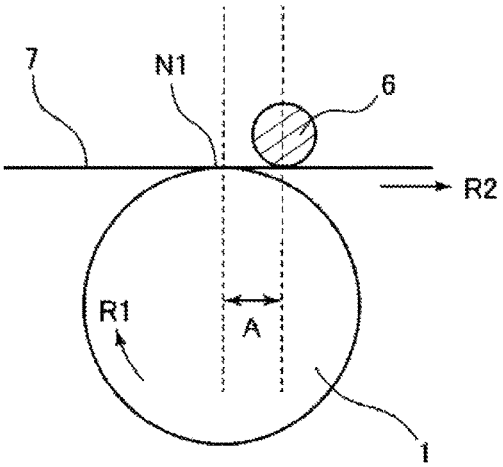
FIG. 2 is a schematic view for illustrating an arrangement of a primary transfer roller.

FIG. 2 is a sectional view, as seen in a rotational axis direction of the photosensitive member 1, schematically showing a neighborhood of the primary transfer portion N1 in this embodiment. In this embodiment, the primary transfer roller 6 is disposed so as to be offset downstream from the photosensitive member 1 with respect to a movement direction (feeding direction) of the intermediary transfer belt 7. Particularly, in this embodiment, with respect to the movement direction of the intermediary transfer belt 7, the primary transfer roller 6 is disposed so that there is no region of the intermediary transfer belt 7 contacting both of the photosensitive member 1 and the primary transfer roller 6. In this embodiment, a distance A between a perpendicular line drawn from a rotation center axis of the photosensitive member 1 to the intermediary transfer belt 7 and a perpendicular line drawn from a rotation center axis of the primary transfer roller 6 to the intermediary transfer belt 7 is set at 7 mm in a downstream side with respect to the movement direction of the intermediary transfer belt 7. Further, the primary transfer roller 6 is disposed so as to enter the photosensitive member 1 side by 0.1-0.3 mm. As a press-contact method of the primary transfer roller 6 to the intermediary transfer belt 7, a method in which a bearing (not shown) of the primary transfer roller 6 is urged toward the photosensitive member 1 side by a spring as an urging means and a total pressure applied toward a direction of the photosensitive member 1 is controlled can be employed.

Further, in this embodiment, the intermediary transfer belt 7, the stretching rollers 71-75, the primary transfer rollers 6Y, 6M, 6C and 6K, the belt cleaning device 11 and the like are integrally assembled into an intermediary transfer unit 70, which is detachably mountable to the apparatus main assembly 110. The intermediary transfer unit 70 can be exchanged by an operator such as a user or a service person in the case where the intermediary transfer belt 7 reaches an end of its lifetime. The intermediary transfer unit 70 is provided with an IC tag 76 (FIG. 3) which is an information storing portion as a new unit detecting means. In the IC tag 76, at least information of the number of times of execution (execution or non-execution) of a resistance measuring operation described later is stored.

3. Control Mode

Figure 3:
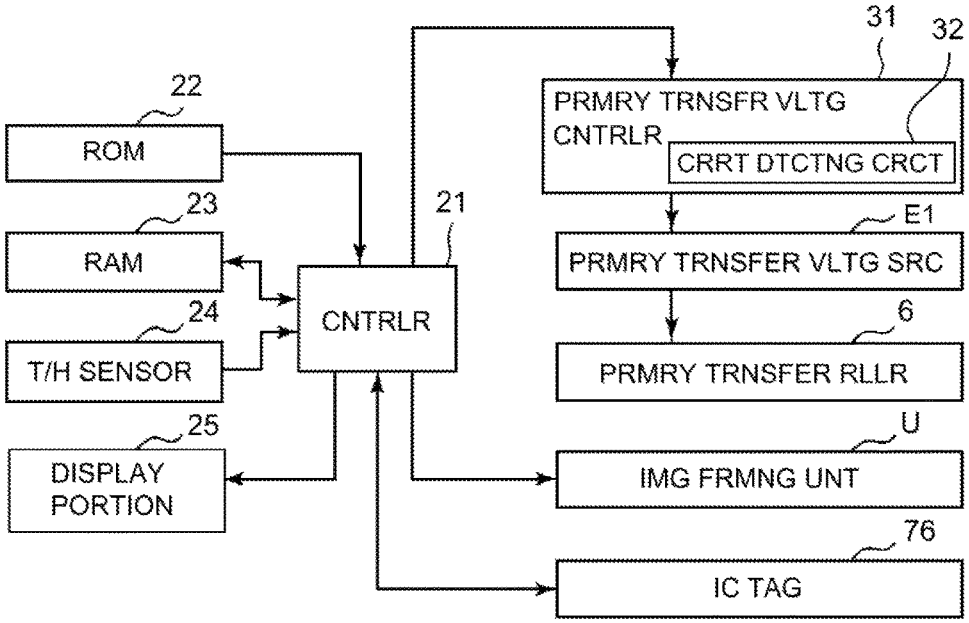
FIG. 3 is a schematic block diagram showing a control mode of a principal part of the image forming apparatus in Embodiment 1.

FIG. 3 is a schematic block diagram showing a control mode in which control of the primary transfer voltage of the image forming apparatus 100 in this embodiment is noticed. A controller 21 provided in the apparatus main assembly 110 of the image forming apparatus 100 controls, on the basis of a control program stored in ROM 22, respective portions of the image forming apparatus 100 while using RAM 23 as a working region (space). In the ROM 22, the control program and various data and tables are stored. The RAM 23 includes a program load region, the working region of the controller 21, storing regions of various data and the like. The controller 21 functions as a counting means and integrates a print number (number of sheets subjected to image formation), subjected to A4-size conversion, every printing operation and causes the RAM 23 to store the print number.

To the controller 21, a primary transfer voltage control circuit 31 is connected. The primary transfer voltage control circuit 31 controls an operation of the primary transfer voltage source E1 under control of the controller 21. The primary transfer voltage source E1 applies the primary transfer voltage to the primary transfer portion N1 through the primary transfer roller 6, and supplies a primary transfer current to the primary transfer portion N1. The primary transfer voltage source E1 is capable of applying a voltage, of a predetermined value designated by the primary transfer voltage control circuit 31, to the primary transfer roller 6 through constant-voltage control. Further, the primary transfer voltage control circuit 31 includes a current detecting portion (ammeter) 32 for detecting a current flowing through the primary transfer portion N1 (primary transfer voltage source E1) by applying the voltage from the primary transfer voltage source E1 to the primary transfer portion N1. Further, the primary transfer voltage source E1 changes an output so that the current detected by the current detecting portion 32 is a predetermined value, and thus is capable of applying the voltage, subjected to constant-current control, to the primary transfer roller 6. That is, the primary transfer voltage control circuit 31 has a function as a constant-current controller for effecting the constant-current control of the voltage, applied from the primary transfer voltage source E1 to the primary transfer portion N1, on the basis of a detection result of the current detecting portion 32. In this embodiment, as described later specifically, a target value of the primary transfer current is set in advance and is stored in the ROM 22. The controller controls the primary transfer voltage, using the information stored in the ROM 22, so as to supply the target primary transfer primary transfer current to the primary transfer portion N1 during the primary transfer.

Further, to the controller 21, a temperature and humidity sensor 24 as an environment detecting means for detecting an environment (at least one of a temperature and a humidity in at least one of an inside and an outside of the apparatus main assembly 110) in which the image forming apparatus 100 is used. In this embodiment, the temperature and humidity sensor 24 detects the temperature and the humidity in the inside of the apparatus main assembly 110 and then sends information thereon to the controller 21. The controller 21 makes reference to temperature and humidity information detected by the temperature and humidity sensor 24 in the case where the temperature and humidity information is needed in the control.

Further, to the controller 21, an operation display portion 25 which is provided in the apparatus main assembly 110 and which has a function of an operating means for inputting an instruction for the controller 21 and a function of a displaying means for displaying the information is connected. The operation display portion 25 displays a message and a menu screen for the operator such as the user or the service person and inputs the instruction to the controller 21 depending on pressing of a button (display region) in the menu screen or a physical button by the operator.

Here, the image forming apparatus 100 performs a job (printing operation, image outputting operation) which is a series of image forming operations which is started by a start instruction (command) and in which an image is formed on a single or a plurality of recording materials S and then is outputted. The job generally includes an image forming step, a pre-rotation step, a sheet interval step in the case where the image is formed on the plurality of the recording materials S, and a post-rotation step. The image forming step is a period in which formation of the electrostatic latent image for an image formed and outputted on the recording material S, formation of the toner image, and primary transfer and secondary transfer of the toner image are performed, and "during image formation" refers to this period. Specifically, timing during the image formation is different at positions where the respective steps including the formation of the electrostatic latent image, the formation of the toner image, and the primary transfer and the secondary transfer of the toner image are performed. The pre-rotation step is a period in which a preparatory operation, from input of the start instruction until the image formation is actually started, before the image forming step is performed. The sheet interval step is a period corresponding to an interval between a recording material S and a subsequent recording material S when the image forming step is continuously performed (continuous image formation) with respect to the plurality of recording material S. The post-rotation step is a period in which a post-operation (preparatory operation) after the image forming step is performed. "During non-image formation" refers to a period other than "during image formation", and includes the pre-rotation step, the sheet interval step, the post-rotation step and further includes a pre-multi-rotation step which is a preparatory operation during main switch actuation of the image forming apparatus 100 or during restoration from a sleep state.

4. Control of Primary Transfer Voltage (Adjustment of Target Value of Primary Transfer Current)

As regards the intermediary transfer belt 7, in order to set an optimum primary transfer current or the like, an electric resistance characteristic thereof is grasped when the intermediary transfer belt 7 is manufactured or mounted in the image forming apparatus 100. In general, this electric characteristic is measured on the basis of a JIS K6911 method and is evaluated using a surface resistivity or a volume resistivity. The surface resistivity is obtained by pressing an electrode (probe) against a sample surface and then by measuring a current flowing through the sample surface, and the volume resistivity is obtained by measuring a current flowing through between upper and lower electrodes of a sample.

On the other hand, the electric characteristic of the intermediary transfer belt 7 varies depending on a variation of the intermediary transfer belt 7 during manufacturing in some instances. Further, by repetitively performing the printing operation from a fresh (new) state of the intermediary transfer belt 7, the electric resistance characteristic of the intermediary transfer belt 7 changes, particularly the surface resistivity lowers in some instances. For that reason, it is desired that the electric resistance characteristic of the intermediary transfer belt 7 is measured in the image forming apparatus 100 so that the primary transfer current depending on the electric resistance characteristic of the intermediary transfer belt 7 can be supplied. However, as described above, a conventional method was not satisfactory in terms of a cost or the like.

Therefore, in this embodiment, a discharge start voltage between the photosensitive member 1 and the intermediary transfer belt 7 is measured in the image forming apparatus 100, and on the basis of the measured discharge start voltage, the primary transfer voltage is controlled. Specifically, in this embodiment, as control of the primary transfer voltage, a target value of the primary transfer current (target current) is adjusted (changed). In the following, description will be made specifically.

Figure 4:
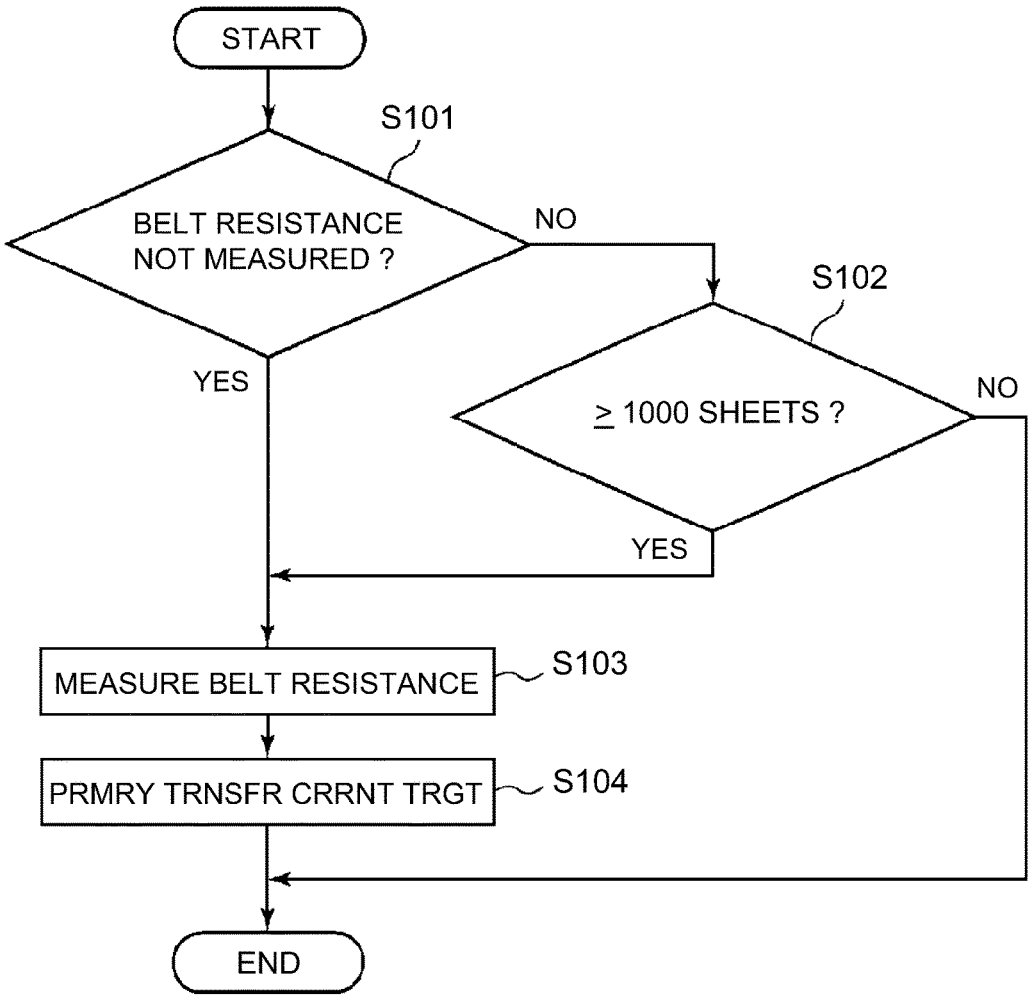
FIG. 4 is a flowchart of control of a primary transfer voltage in Embodiment 1.

FIG. 4 is a flowchart of an operation of adjusting the target value of the primary transfer current by performing a resistance measuring operation in this embodiment. Incidentally, the resistance measuring operation is, as described later, an operation of acquiring the surface resistivity of the intermediary transfer belt 7 on the basis of a discharge start voltage which is acquired in advance.

First, at that time of starting the job or the like time, the controller 21 discriminates whether or not the resistance measuring operation of the intermediary transfer belt 7 used in the printing operation is executed before (S101). The case where the discrimination that the resistance measuring operation is not executed is made is typically the following cases. First, there is a case that the image forming apparatus 100 is first used. Further, there is a case that the intermediary transfer belt 7 is used first after the intermediary transfer unit 70 (intermediary transfer belt 7) is exchanged. In this embodiment, information on the number of times of execution of the resistance measuring operation is stored in an IC tag 76 of the intermediary transfer unit 70. The controller 21 renews the number of times of execution every execution of the resistance measuring operation and stores the renewed number of times of execution in the IC tag 76. Accordingly, the controller 21 can discriminate execution or non-execution of the resistance measuring operation by reading the information on the number of times of execution stored in the IC tag 76. Incidentally, the controller 21 may also discriminate that the resistance measuring operation is not executed by inputting information, through the operation display portion 25, to the effect that the intermediary transfer belt 7 is exchanged.

In S101, in the case where discrimination that the resistance measuring operation is not executed is made, the controller 21 executes the resistance measuring operation (S103). The resistance measuring operation will be specifically described later.

In S101, in the case where discrimination that the resistance measuring operation has been executed is made, the controller 21 discriminates whether or not a cumulative print number in an A4 conversion basis from the last resistance measuring operation is 1000 sheets or more (S102). In S102, if discrimination that the print number is not less than 1000 sheets is made, the controller 21 executes the resistance measuring operation (S103).

In S103, the resistance measuring operation is executed, and thereafter, the controller 21 adjusts (determines) a target value of the primary transfer current (primary transfer current target) on the basis of a result of the resistance measuring operation (S104).

Figure 5:
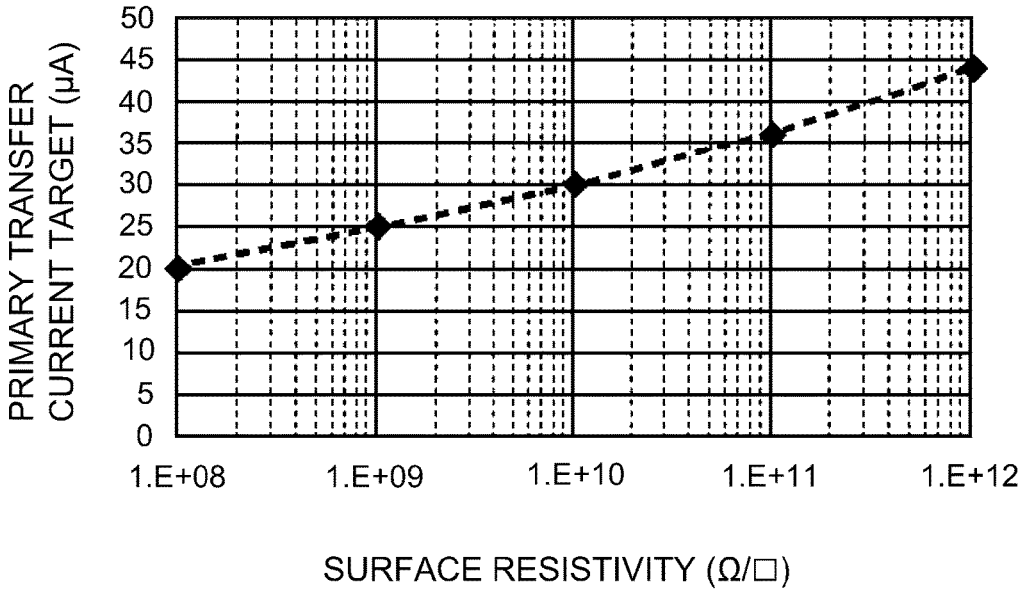
FIG. 5 is a graph showing a relationship between a surface resistivity of an intermediary transfer belt and a primary transfer current target (value).

FIG. 5 is a graph showing an example of a relationship between the target value of the primary transfer current (primary transfer current target) and the surface resistivity of the intermediary transfer belt 7. In this embodiment, information (table) indicating this relationship is stored in the ROM 22 in advance. The controller 21 adjusts the primary transfer current target value on the basis of the surface resistivity of the intermediary transfer belt 7 acquired by the resistance measuring operation as described later and the information indicating the relationship as shown in FIG. 5.

5. Resistance Measuring Operation

Figure 6:
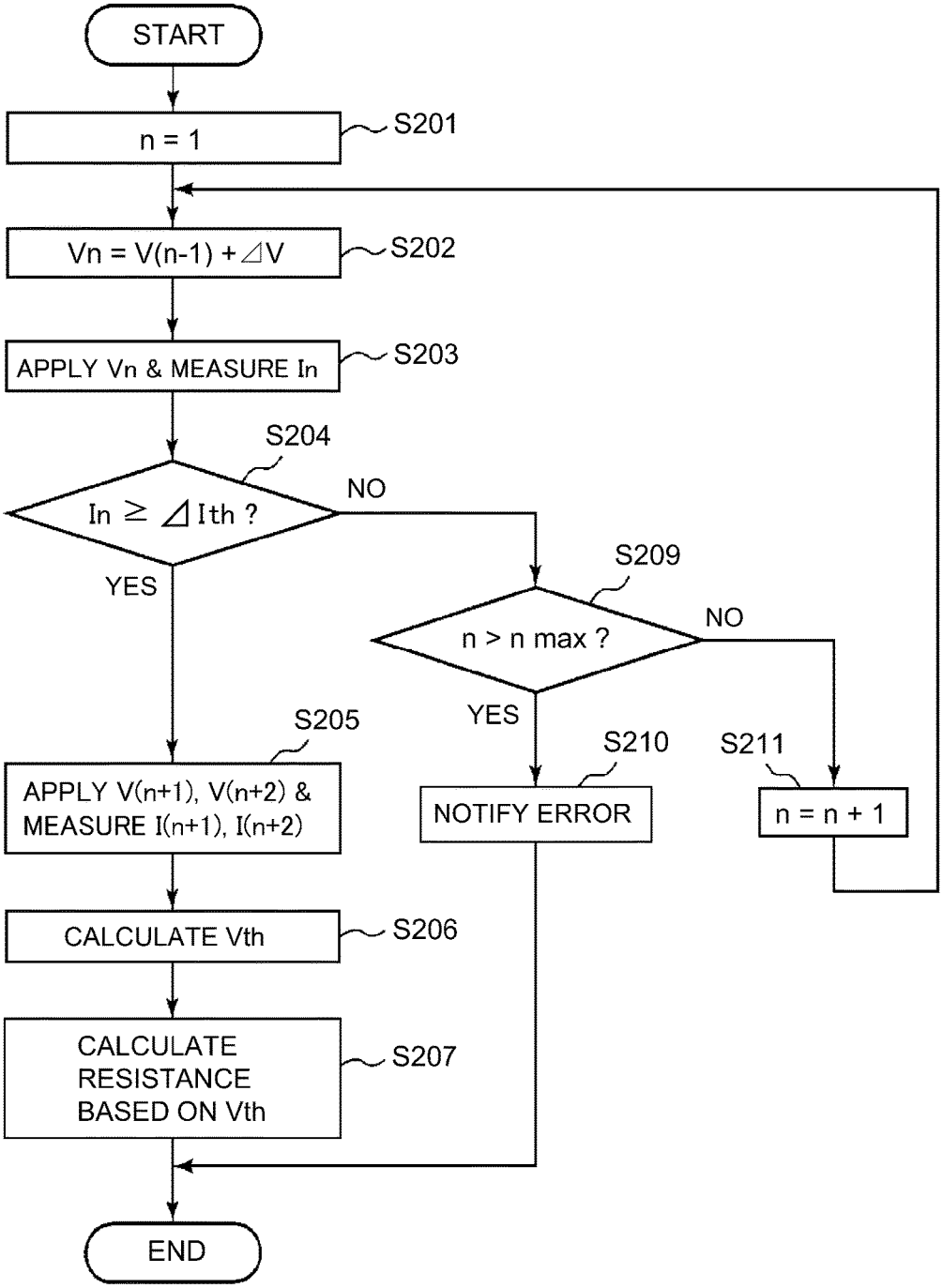
FIG. 6 is a flowchart of a resistance measuring operation in Embodiment 1.
Figure 7:
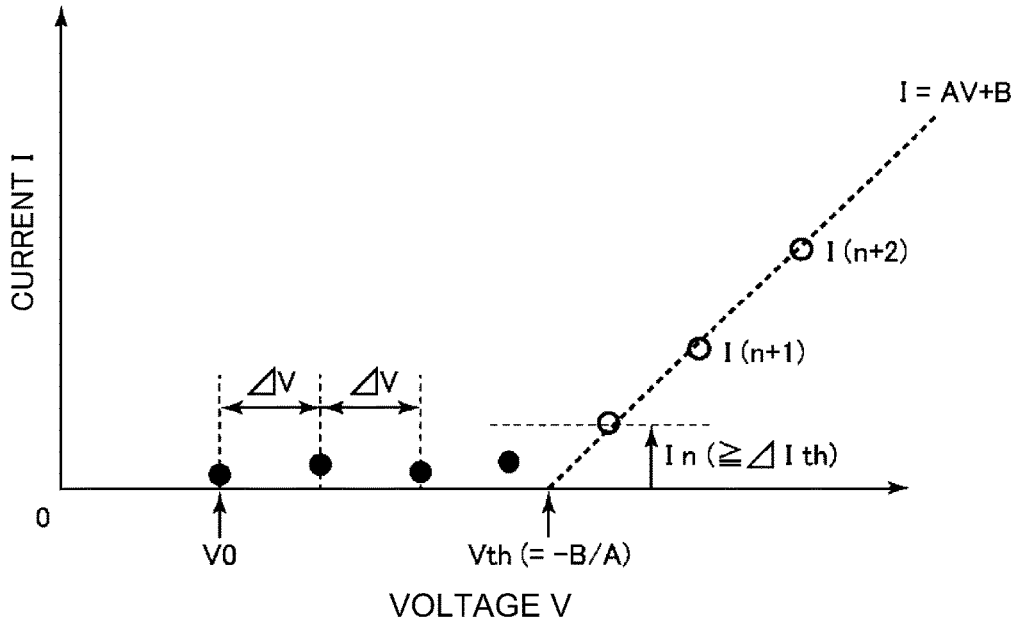
FIG. 7 is a graph showing a relationship between a current and a voltage at a primary transfer portion during the resistance measuring operation in Embodiment 1.

Next, the resistance measuring operation in this embodiment will be described. FIG. 6 is a flowchart of the resistance measuring operation in this embodiment. FIG. 7 is a graph showing a relationship between a current and a voltage at the primary transfer portion N1 during the resistance measuring operation. Incidentally, the resistance measuring operation may only be required to be carried out at least one of the plurality of primary transfer portions N1. Herein, an arbitrary one primary transfer portion N1 is noticed and will be described (ditto for other embodiments). In this embodiment, the resistance measuring operation is performed at the primary transfer portion N1Y of the first image forming portion.

First, the controller 21 sets an integer n as 1 (initial value) (S201) and causes the primary transfer voltage source E1 to apply a voltage Vn ($=V(n-1)+\Delta V$) to the primary transfer roller 6 (S202) and then causes the current detecting portion 32 to measure a current In (=I1) at that time (S203). In this embodiment, Vn (=V1) when n=1 is 50 V. That is, in this embodiment, V0 is 10 V and $\Delta V$ is 40 V. The V1 is set at a value lower than the discharge start voltage in the case where the intermediary transfer belt 7 reaches an end of its lifetime and the surface resistivity lowers to a lower limit. Incidentally, the measurement of the current In is carried out in a state in which the photosensitive member 1 and the intermediary transfer belt 7 are rotationally driven under the same condition as that during the image formation and in which the photosensitive member 1 is not subjected to the charging process and the exposure process and the developing device 4 is spaced from the photosensitive member 1. The current In is an average obtained by averaging current values sampled at a predetermined sampling cycle. This sampling is carried out over a time, as a sampling period, corresponding to one-full-circumference of the intermediary transfer belt 7. As another method, an average obtained by averaging current values sampled over a tie, as the sampling period, less than a tie such as a time corresponding to ¼ of one-full-circumference of the intermediary transfer belt 7 may also be used as the current In. In order to improve measurement accuracy of the discharge start voltage, it is preferable that the sampling is carried out over not less than the time corresponding to the one-full-circumference of the intermediary transfer belt 7 and the electric resistance characteristic of the intermediary transfer belt 7 for the full circumference is grasped as an average.

Next, the controller 21 discriminates whether or not the last measured In is not less than a predetermined threshold ΔIth (2 μA in this embodiment) (S204). This threshold ΔIth is set at a value at which it can be discriminated that the current flows through the primary transfer portion N1 even in consideration of a detection error (0.5 μA in this embodiment) of the current detecting portion 32. On the other hand, when the threshold ΔIth is set at an excessively large value, the error increases when the discharge start voltage is acquired, and therefore may desirably be set at a small value to the extent possible in consideration of the influence of a sharing voltage described later.

In the case where the controller 21 discriminated that the current In is not ΔIth or more in S204, the controller 21 discriminates whether or not n exceeds a maximum $n_{max}$ (50 in this embodiment) (S209). In S209, in the case where the controller 21 discriminated that n does not exceed the maximum $n_{max}$, the controller adds 1 to n (S211) and returns the process to S202. On the other hand, in S209, in the case where the controller 21 discriminated that n exceeds the maximum $n_{max}$, the controller 21 causes the operation display portion 25 to display an error message notifying the operator of detection of abnormality during the control (S210) and ends the operation. The maximum $n_{max}$ is an integer not less than a value at which In is not less than the threshold ΔIth even in the case where the surface resistivity of the intermediary transfer belt 7 is an upper limit.

In S204, in the case where the controller 21 discriminated that the current In is not less than ΔIth, the controller 21 causes the primary transfer voltage source E1 to apply V(n+1) and V(n+2) successively for n when In is not less than the threshold ΔIth, and causes the current detecting portion 32 to measure I(n+1) and I(n+2), respectively (S205).

Thereafter, the controller 21 acquires a discharge start voltage Vth in the following manner (S206). That is, the controller 21 subjects the relationship between the voltage and the current to linear approximation through the method of least squares using the measured values In, I(n+1) and I(n+2) (white circulates in FIG. 7) which are not less than the threshold ΔIth and corresponding values Vn, V(n+1) and V(n+2). That is, an equation, showing a current-voltage characteristic in the case where the current is not less than the threshold ΔIth, represented by the following formula is obtained.

$$I=AV+B$$

Then, on the basis of the thus-obtained formula, the controller 21 calculates the discharge start voltage Vth from the following formula.

$$Vth=-B/A$$

That is, the controller 21 acquires, as the discharge start voltage Vth, a voltage value in the case where a current value in the obtained current-voltage characteristic is zero.

Figure 8:
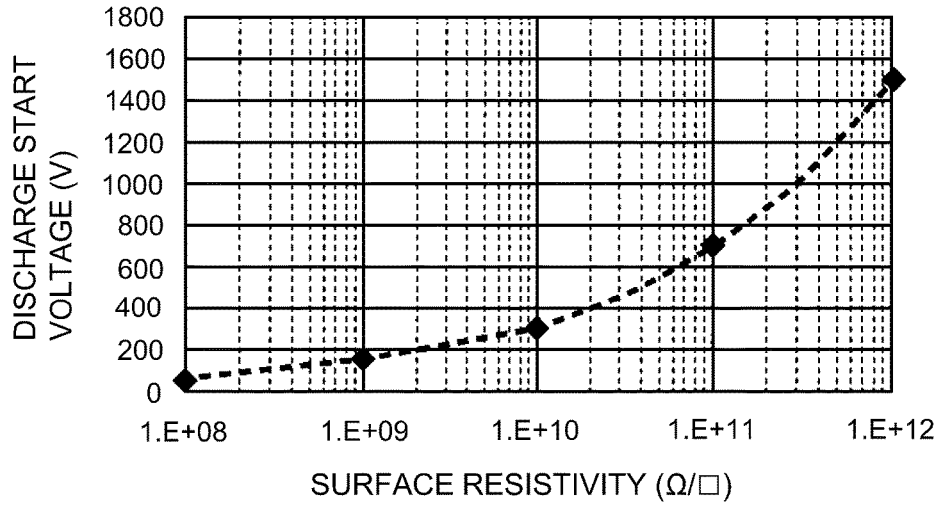
FIG. 8 is a graph showing a relationship between the surface resistivity of the intermediary transfer belt and a discharge start voltage.

Thereafter, the controller 21 acquires the surface resistivity of the intermediary transfer belt 7 in the following manner (S207). That is, as shown in FIG. 8, there is a correlation between the discharge start voltage Vth and the surface resistivity of the intermediary transfer belt 7. In this embodiment, information (table) showing the relationship between the discharge start voltage Vth and the surface resistivity of the intermediary transfer belt 7 is stored in advance in the ROM 22. The controller 21 acquires the surface resistivity of the intermediary transfer belt 7 on the basis of the discharge start voltage Vth obtained as described above and the information showing the relationship as shown in FIG. 8. Then, the controller 21 ends the resistance measuring operation.

Thus, in this embodiment, by detecting the discharge start voltage which is a voltage at which a current starts to flow from the primary transfer roller 6 to the photosensitive member 1 via the intermediary transfer belt 7, the surface resistivity of the intermediary transfer belt 7 is measured. When the surface resistivity of the intermediary transfer belt 7 is high, at the same primary transfer current, a potential difference between the photosensitive member 1 and the intermediary transfer belt 7 at the primary transfer portion N1 becomes small. For that reason, the current does not readily flow between the photosensitive member 1 and the intermediary transfer belt 7, so that the discharge start voltage increases. Based on this characteristic, by checking the discharge start voltage, it is possible to measure the surface resistivity of the intermediary transfer belt 7.

Figure 15:
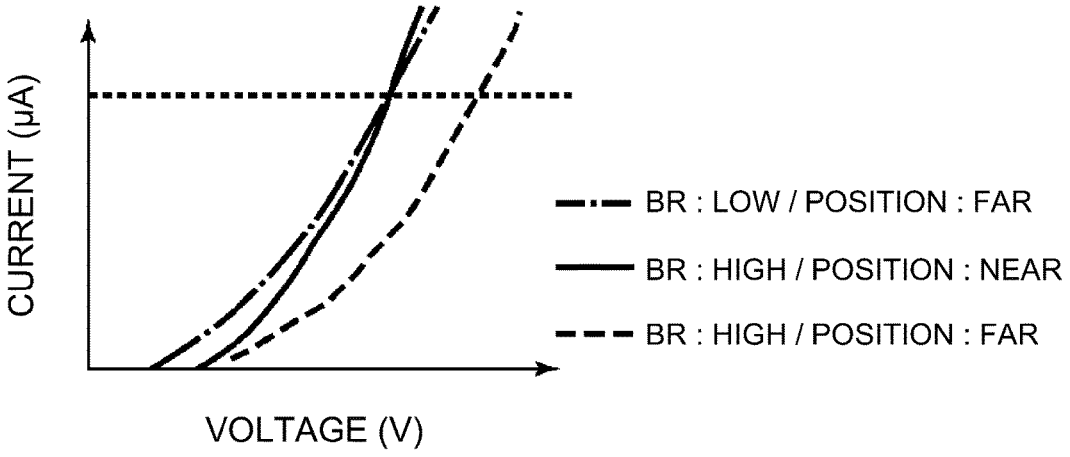
FIG. 15 is a graph for illustrating a difference of a relationship between a voltage applied to a primary transfer roller and a current flowing through a primary transfer portion due to a difference in position of the primary transfer roller.

Here, as described above, a method of indirectly knowing the electric resistance characteristic of the intermediary transfer belt 7 by measuring the voltage when a predetermined primary transfer current equal to that during the primary transfer step is caused to flow, for example, would be considered. However, as described above with reference to FIG. 15, the case where the electric resistance characteristic of the intermediary transfer belt 7 cannot be accurately known depending on the position of the primary transfer roller 6 exists. On the other hand, in this embodiment, the discharge start voltage is acquired by measuring a minute current flowing at the voltage close to the discharge start voltage. Then, on the basis of the acquired discharge start voltage, the surface resistivity of the intermediary transfer belt 7 is acquired. As a result, the influence of voltage drop due to a sharing voltage from the primary transfer voltage source E1 to the primary transfer portion N1 (principally of the intermediary transfer belt 7) is minimized, so that ease of the electric discharge between the photosensitive member 1 and the intermediary transfer belt 7 can be measured. Then, on the basis thereof, the surface resistivity of the intermediary transfer belt 7 can be acquired. Accordingly, according to this embodiment, in a constitution which is simple and advantageous in terms of cost reduction, the electric resistance characteristic (surface resistivity) of the intermediary transfer belt 7 can be accurately measured in the image forming apparatus 100 irrespective of the difference in position of the primary transfer roller 6.

Thus, in this embodiment, the measuring operation in which the discharge start voltage between the photosensitive member 1 and the intermediary transfer belt 7 is acquired on the basis of the relationship between the voltage and the current measured by applying the voltage from the primary transfer voltage source E1 to the primary transfer portion N1 is executed by the controller 21. Then, the controller 21 controls, on the basis of the acquired discharge start voltage, the primary transfer voltage applied from the primary transfer voltage source E1 to the primary transfer portion N1. Particularly, in this embodiment, the controller 21 adjusts, on the basis of the discharge start voltage, the target value of the primary transfer current supplied to the primary transfer portion N1 during the primary transfer. At this time, the controller 21 carries out the adjustment so that a target value of the primary transfer current when an absolute value of the discharge start voltage is a second value smaller than a first value is made smaller than a target value of the primary transfer current when the absolute value of the discharge start voltage is the first value. In the measuring operation, from the primary transfer voltage source E1 to the primary transfer portion N1, a voltage having at least one value at which a current value detected by the detecting portion 32 is less than a predetermined value and voltages having at least two values at which the current value detected by the detecting portion 32 is not less than the predetermined value are applied. Here, the voltage having at least one value at which the current value detected by the detecting portion 32 is a voltage which is smaller than the discharge start voltage between the photosensitive member 1 and the intermediary transfer belt 7 through a set period of the lifetime of the intermediary transfer belt 7. Then, the discharge start voltage is acquired on the basis of the relationship between the current and the voltage in the case where the current value detected by the detecting portion 32 is not less than the predetermined value.

Particularly, in this embodiment, in the measuring operation, the absolute value of the voltage applied to the primary transfer portion N1 by the primary transfer voltage source E1 is successively increased, and when the respective voltages are applied, the currents flowing through the primary transfer portion N1 are detected. Further, in this embodiment, in the measuring operation, the relationship between the current and the voltage in the case where the current value detected by the detecting portion 32 is not less than the predetermined value is subjected to linear approximation, so that a voltage value in the case where the current value in the relationship between the current and the voltage subjected to the linear approximation is zero is acquired as the discharge start voltage. Incidentally, the above-described predetermined value is a current value which is not less than a value at which discrimination that the current flows through between the photosensitive member 1 and the intermediary transfer belt 7 while exceeding a range of a detection error of the detecting portion 32 can be made, and typically is 0.5 μA or more and 2.0 μA or less.

As described above, according to this embodiment, in the constitution which is simple and advantageous in terms of cost reduction, by applying, to the primary transfer portion N1, the primary transfer voltage depending on the electric resistance characteristic (surface resistivity) of the intermediary transfer belt 7, a good transfer property can be realized.

Embodiment 2

Next, another embodiment of the present invention will be described. Basic constitutions and operations of an image forming apparatus in this embodiment are the same as those in Embodiment 1. Accordingly, in the image forming apparatus in this embodiment, elements having the same or corresponding functions and constitutions as those in the image forming apparatus in Embodiment 1 are represented by the same reference numerals or symbols and will be omitted from detailed description.

1. Summary of this Embodiment

In this embodiment, an intermediary transfer belt 7 is formed of a material containing anion-conductive material and thus has ion-conductivity. The intermediary transfer belt 7 having the ion-conductivity possess a feature such that a surface resistivity easily fluctuates depending on a fluctuation in environment.

Further, in this embodiment, as a primary transfer roller 6, a rubber roller is used. In this embodiment, the primary transfer roller 6 is an elastic roller prepared by forming an elastic layer containing an ion-conductive material at a peripheral surface of a stainless steel-made core metal of 320 mm in longitudinal length and 8 mm in diameter. The primary transfer roller 6 is $5\times10^5$-$1\times10^6\Omega$ in roller resistance (volume resistivity) and 16 mm in diameter. As the primary transfer roller 6, for example, a polyurethane foam roller containing an ion-conductive substance or a nitrile-butadiene rubber (NBR) foam roller containing the ion-conductive substance can be used. In this embodiment, the NBR foam roller containing the ion-conductive substance was used. Incidentally, a roller using carbon black as an electron-conductive material, for example, an ethylene-propylene-diene rubber (EPDM) foam roller in which carbon black is dispersed may also be used. However, it is difficult for the elastic roller containing the electron-conductive material to obtain a stable dispersing property of the electron-conductive material, and it is difficult to adjust a fluctuation in electric resistance value. For that reason, in mass production, it is difficult to maintain a stable electric resistance within, e.g., one digit (for example, $1\times10^9$-$1\times10^{10}\Omega$). On the other hand, the elastic roller using the ion-conductive material has a feature such that a stable electric resistance is easily obtained.

Further, in this embodiment, a single predetermined current is caused to flow through the primary transfer portion N1 under constant-current control, and by measuring a voltage at that time, a discharge start voltage is acquired. Incidentally, as described in Embodiment 1, in this embodiment, the primary transfer voltage source E1 is capable of applying a voltage, subjected to the constant-current control, to the primary transfer roller 6.

2. Control of Primary Transfer Voltage (Adjustment of Target Value of Primary Transfer Current)

Figure 9:
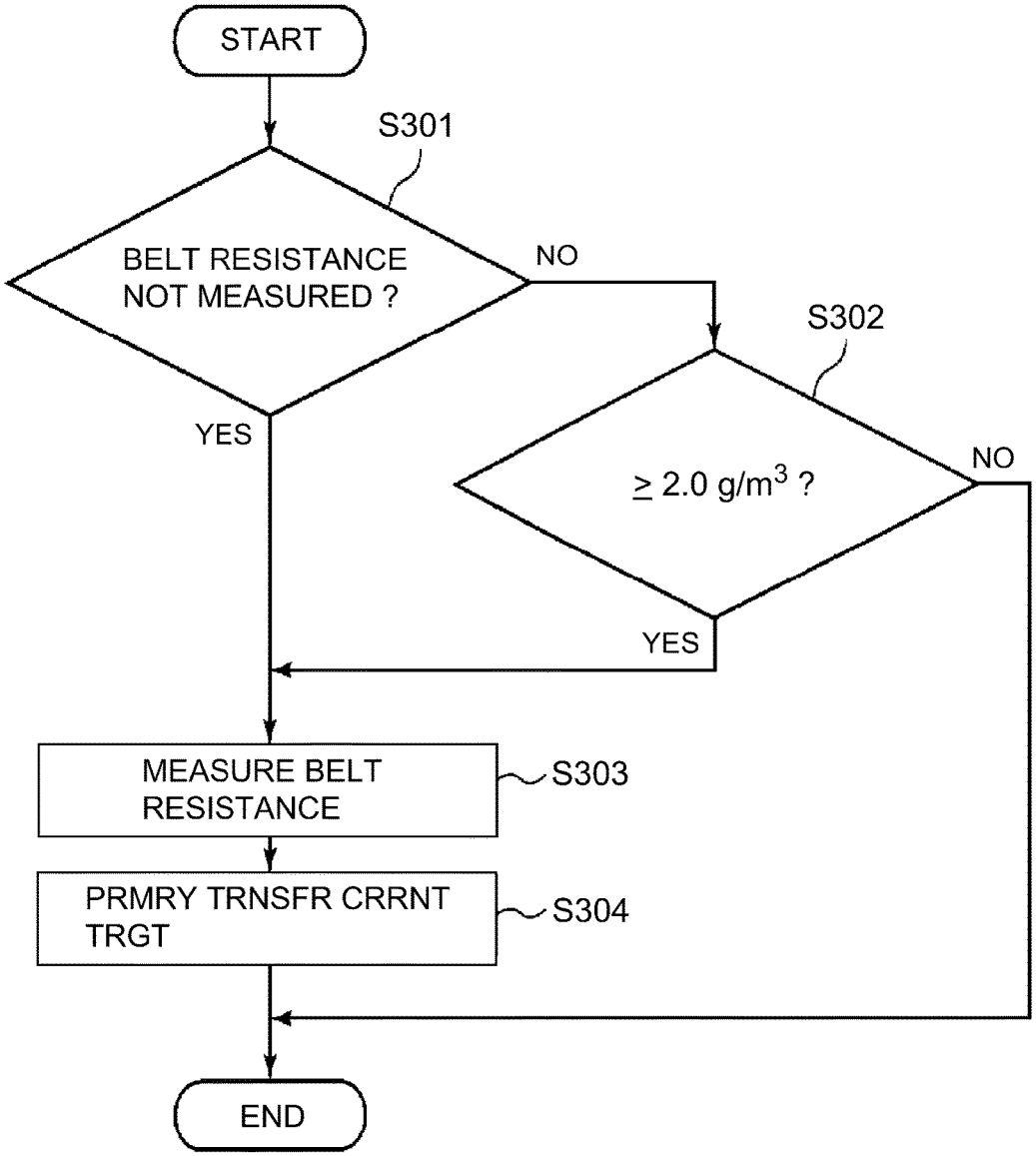
FIG. 9 is a flowchart of control of a primary transfer voltage in Embodiment 2.

FIG. 9 is a flowchart of an operation of adjusting the target value of the primary transfer current by performing a resistance measuring operation.

In FIG. 9, processes in S301, S303 and S304 are similar to those in S101, S103 and S104, respectively, in FIG. 4 described in Embodiment 1. However, a resistance measuring operation executed in S303 is different from that in Embodiment 1. The resistance measuring operation in this embodiment will be described later specifically.

In this embodiment, in the case where the controller 21 discriminated that the resistance measuring operation has been executed is made in S301, the controller 21 discriminates whether or not a difference between an absolute water content during the last resistance measuring operation and a current absolute water content is not less than a predetermined threshold (2.0 g/m$^3$ in this embodiment) (S302). This is because in this embodiment, the ion-conductive intermediary transfer belt 7 is used and therefore the surface resistivity of the intermediary transfer belt 7 is liable to change due to a fluctuation in environment. Incidentally, the controller 21 acquires the absolute water content from temperature and humidity information sent from the temperature and humidity sensor 24, and in the case where the resistance measuring operation is executed, information on the absolute water content at that time is stored in the RAM 23. In S302, discrimination that the difference is not less than the threshold is made, the controller 21 executes the resistance measuring operation (S303).

3. Resistance Measuring Operation

Figure 10:
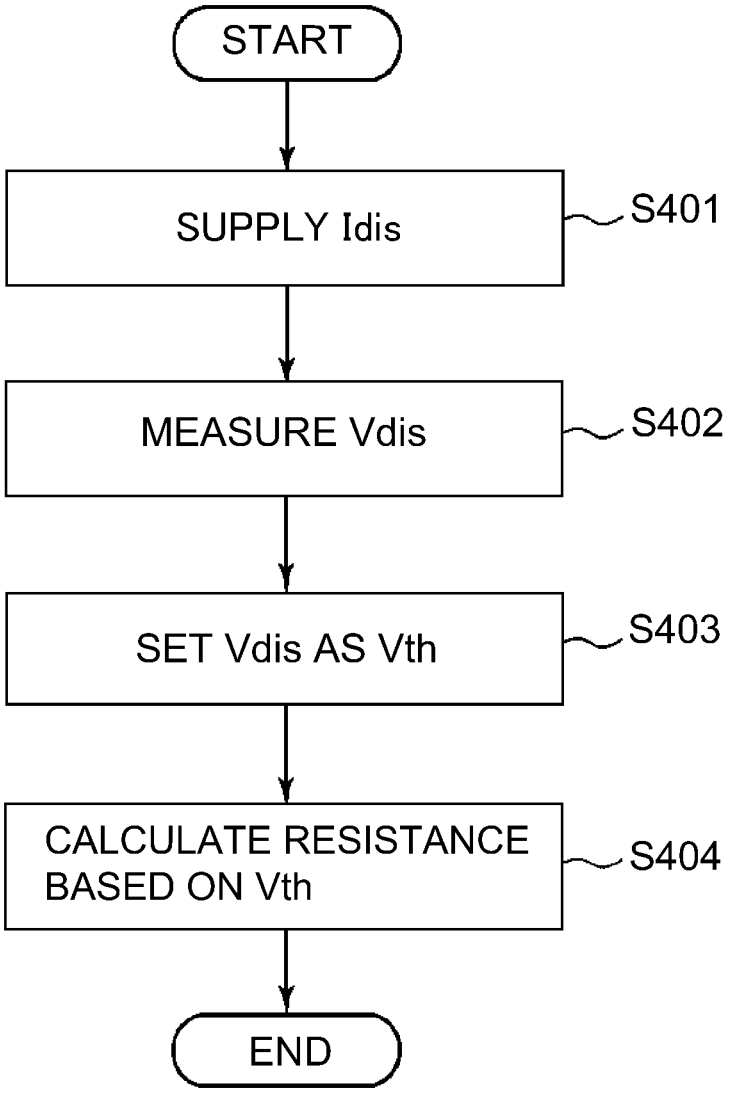
FIG. 10 is a flowchart of a resistance measuring operation in Embodiment 2.

Next, the resistance measuring operation in this embodiment will be described. FIG. 10 is a flowchart of the resistance measuring operation in this embodiment.

First, the controller 21 causes the primary transfer voltage source E1 to apply a voltage, to the primary transfer roller 6, which is subjected to constant-current control so that a current measured by the current detecting portion 32 is a predetermined current Idis (S401), and the voltage at that time is sampled in a predetermined sampling period (S402). Then, the controller 21 acquires, as the discharge start voltage Vth, an average obtained by averaging sampled voltage values (S403). Then, the controller 21 acquires the surface resistivity of the intermediary transfer belt 7 on the basis of the acquired discharge start voltage Vth similarly as in Embodiment 1 (S404).

In the case where the primary transfer roller 6 is an elastic roller, as regards the electric resistance of the primary transfer roller 6, roller period non-uniformity exists, and therefore it is desirable that the influence of the roller period on electric resistance non-uniformity is suppressed by setting the above-described sampling period at a time not less than a time corresponding to one-full-circumference of the primary transfer roller 6. Incidentally, the sampling period is similar to that in Embodiment 1.

Further, the above-described predetermined current Idis is set at a small value to the extent possible. In this embodiment, this current Idis was 1 μA. By making the value of the current Idis sufficiently small, the influence of voltage drop due to a sharing voltage from the primary transfer voltage source E1 to the primary transfer portion N1 (principally of the intermediary transfer belt 7 and the primary transfer roller 6) is minimized, so that ease of the electric discharge between the photosensitive member 1 and the intermediary transfer belt 7 can be measured. Then, on the basis thereof, the surface resistivity of the intermediary transfer belt 7 can be acquired.

Further, in the case where it is considered that the electric resistance of the primary transfer roller 6 is large and has a non-negligible influence on a measurement result of the above-described voltage as the discharge start voltage, the influence may also be eliminated by correcting the measurement result of the above-described voltage depending on the electric resistance of the primary transfer roller 6. For example, the electric resistance of the primary transfer roller 6 is predicted depending on ambient temperature and humidity information. Then, a difference from a true discharge start voltage contained in the measurement result of the above-described voltage is predicted depending on the electric resistance. Then, by subtracting the difference from the above-described voltage measurement result, the discharge start voltage can be acquired. In this case, for example, a relationship between a detection result of the ambient temperature and humidity information by the temperature and humidity sensor 24 and the electric resistance of the primary transfer roller 6 is acquired in advance. Further, a relationship between the electric resistance of the primary transfer roller 6 and the difference from the true discharge start voltage contained in the above-described voltage measurement result is acquired in advance. Incidentally, a relationship between the detection results of the ambient temperature and humidity information by the temperature and humidity sensor 24 and the difference from the true discharge start voltage contained in the above-described voltage measurement result may also be acquired.

Thus, in this embodiment, in the measuring operation, the voltage is applied under the constant-current control so that a predetermined current is caused to flow through the primary transfer portion N1 by the primary transfer voltage source E1, and the discharge start voltage is acquired on the basis of a voltage value at that time. Here, the above-described predetermined current is a current which is not less than a value at which discrimination that the current flows through between the photosensitive member 1 and the intermediary transfer belt 7 while exceeding a range of a detection error of the detecting portion 32 can be made, and typically is 0.5 μA or more and 2.0 μA or less.

As described above, according to this embodiment, an effect similar to that in Embodiment 1 can be obtained by a simpler control.

Incidentally, also as regards the case where the resistance measuring operation in Embodiment 1 is applied, in the case where the intermediary transfer belt 7 has the ion-conductivity or in the like case, the resistance measuring operation can be carried out in the case where the environment changes to a certain extent similarly as in this embodiment.

Further, in the case where the resistance measuring operation in Embodiment 1 is applied, similarly as in Embodiment 1, the primary transfer roller 6 may also be the rubber roller. Also in that case, according to the method in Embodiment 1, the influence of the voltage drop due to the sharing voltage from the primary transfer voltage source E1 to the primary transfer portion N1 (principally of the intermediary transfer belt 7 and the primary transfer roller 6) is minimized, so that ease of the electric discharge between the photosensitive member 1 and the intermediary transfer belt 7 can be measured.

Further, in the constitution of Embodiment 1, similarly as in this embodiment, the method of acquiring the discharge start voltage by causing the single minute control to flow under the constant-current control can also be applied.

Embodiment 3

Next, another embodiment of the present invention will be described. Basic constitutions and operations of an image forming apparatus in this embodiment are the same as those in Embodiment 1. Accordingly, in the image forming apparatus in this embodiment, elements having the same or corresponding functions and constitutions as those in the image forming apparatus in Embodiment 1 are represented by the same reference numerals or symbols and will be omitted from detailed description.

In Embodiment 1, the discharge start voltage was acquired from the relationship between the current and the voltage in the neighborhood of the discharge start voltage through the linear approximation. The current flowing at the voltage in the neighborhood of the discharge start voltage is small, and therefore it would be considered that in the case where a measurement error of the current detecting portion 32 is large or in the like case, a detected current fluctuates and thus it becomes difficult to acquire the discharge start voltage with accuracy. Therefore, in this embodiment, the discharge start voltage is acquired from a relationship between a current and a voltage containing a voltage (e.g., equal to the primary transfer voltage during the primary transfer) sufficiently higher than the discharge start voltage through approximation with a quadratic function. As a result, a ratio of the measurement error to a current measurement result can be lowered, so that measurement accuracy of the discharge start voltage is improved in some cases.

Figure 11:
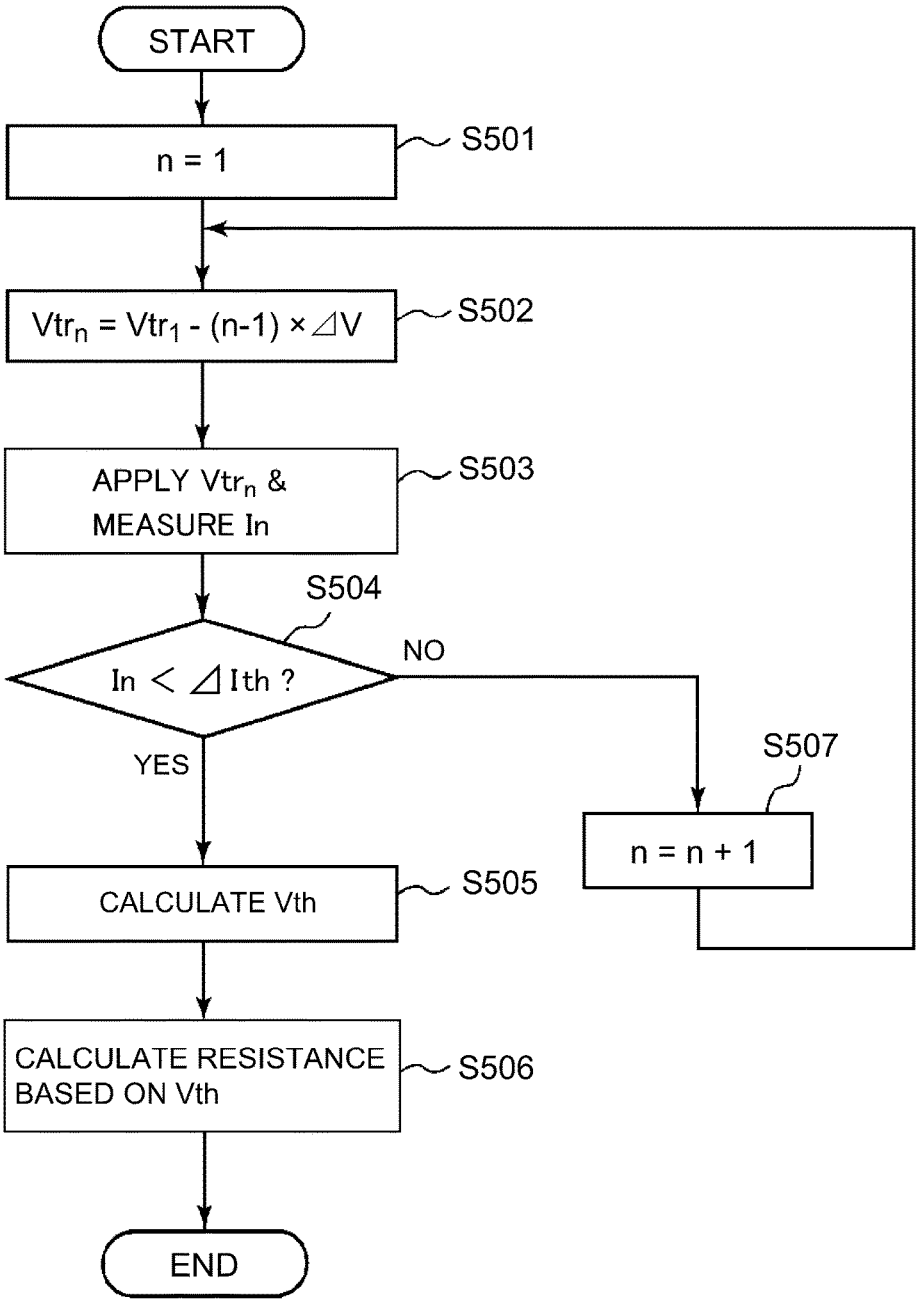
FIG. 11 is a flowchart of a resistance measuring operation in Embodiment 3.
Figure 12:
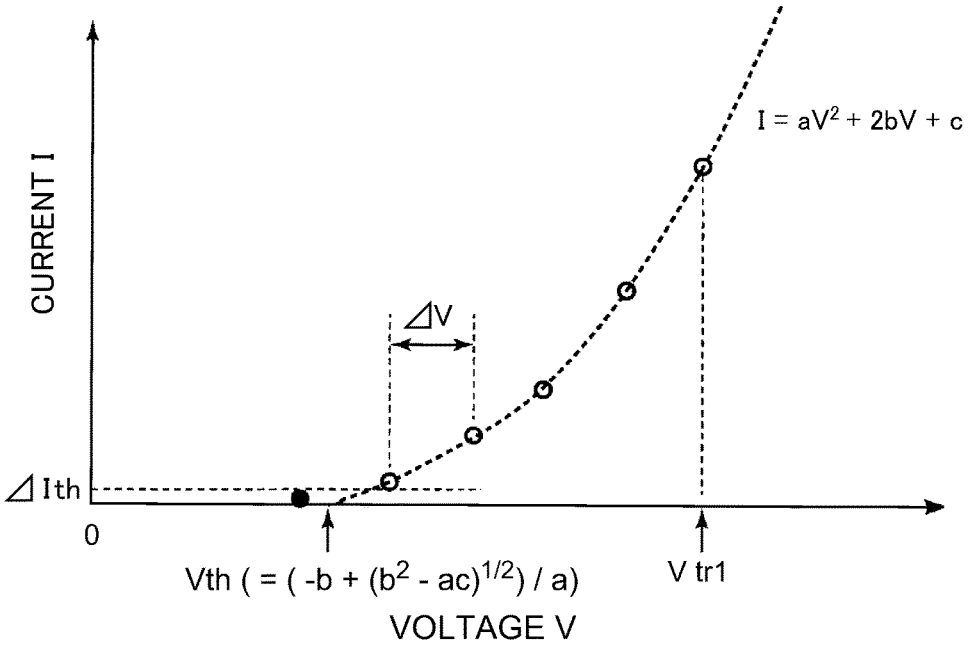
FIG. 12 is a graph showing a relationship between a current and a voltage at a primary transfer portion during the resistance measuring operation in Embodiment 3.

With reference to FIGS. 11 and 12, the resistance measuring operation in this embodiment will be described. FIG. 11 is a flowchart of the resistance measuring operation in this embodiment. FIG. 12 is a graph showing a relationship between a current and a voltage at the primary transfer portion N1 during the resistance measuring operation in this embodiment. Incidentally, in this embodiment, the resistance measuring operation is performed in accordance with the flowchart shown in FIG. 4 similarly as in Embodiment 1, so that an operation of controlling the primary transfer voltage is controlled.

First, the controller 21 sets an integer n as 1 (initial value) (S501) and causes the primary transfer voltage source E1 to apply a voltage $Vtr_n$ ($=Vtr_1(n-1)\times\Delta V$) to the primary transfer roller 6 (S502) and then causes the current detecting portion 32 to measure a current In (=I1) at that time (S503). In this embodiment, $Vtr_n$ ($=Vtr_n$) when n=1 is, e.g., 1500 V. That is, in this embodiment, $Vtr_1$ is a voltage value necessary to cause the target primary transfer current during the last primary transfer step to flow. Further, in this embodiment, ΔV is 100 V. Incidentally, the current In is an average obtained by averaging current values sampled at a predetermined sampling cycle over a predetermined sampling period similarly as in Embodiment 1.

Next, the controller 21 discriminates whether or not the last measured In is smaller than a predetermined threshold ΔIth (2 μA in this embodiment) (S504). This threshold ΔIth is a preset value similar to that in Embodiment 1.

In S504, in the case where the controller 21 discriminated that In is not smaller than the threshold ΔIth, the controller adds 1 to n (S507) and returns the process to S502. That is, an operation of measuring a current by applying a voltage lowered from $Vtr_1$ by ΔV (100 V in this embodiment) is repeated until the measured current is below the threshold ΔIth (2 μA in this embodiment).

In the case where the controller 21 discriminated that the current In is smaller than ΔIth in S504, the controller 21 acquires a discharge start voltage Vth in the following manner (S505). That is, the controller 21 subjects the relationship between the voltage and the current to approximation with the quadratic function through the method of least squares using the measured values of In excluding the last measured In (black dot in FIG. 12) and corresponding values of $Vtr_n$. That is, an equation, showing a current-voltage characteristic in the case where the current is not less than the threshold ΔIth, represented by the following formula is obtained.

$$I=aV^2+2bV+c$$

Then, on the basis of the thus-obtained formula, the controller 21 calculates the discharge start voltage Vth from the following formula.

$$Vth=(-b+(b^2-ac)^{1/2})/a$$

That is, the controller 21 acquires, as the discharge start voltage Vth, a voltage value in the case where a current value in the obtained current-voltage characteristic is zero.

Then, the controller 21 acquires the surface resistivity of the intermediary transfer belt 7 on the basis of the acquired discharge start voltage Vth similarly as in Embodiment 1 (S506).

In this embodiment, the measurement result is subjected to approximation with the quadratic function, so that the current-voltage characteristic is acquired, and therefore the value of ΔV is set so as not to be excessively large in order to be subjected to the approximation at least at three points or more.

Figure 13:
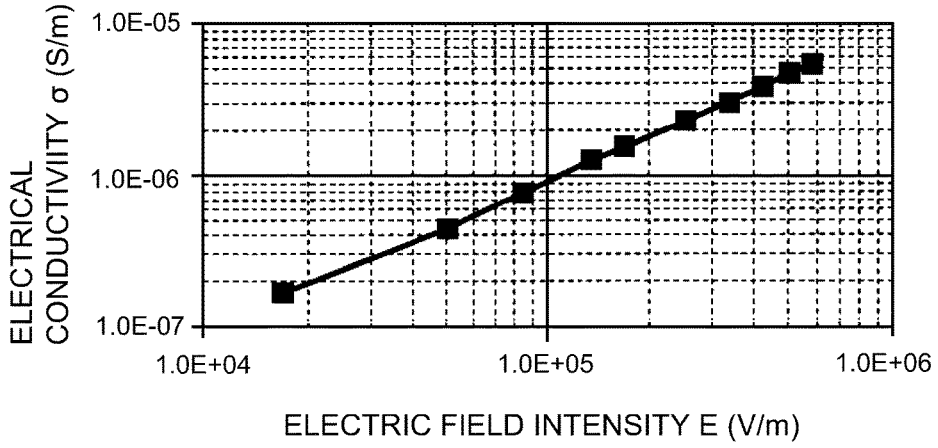
FIG. 13 is a graph showing a relationship between electric field intensity and electrical conductivity of an intermediary transfer belt.
Figure 14:
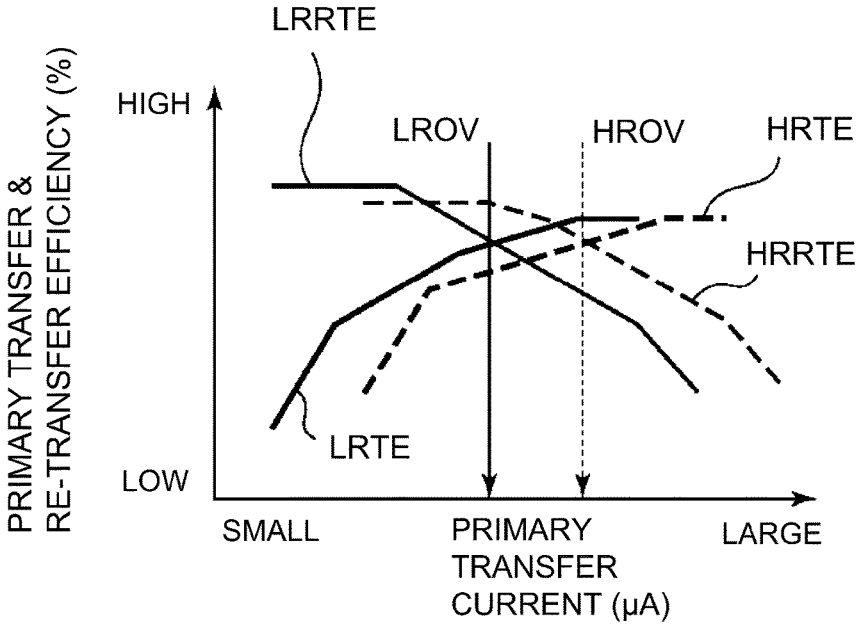
FIG. 14 is a graph for illustrating a difference of a relationship between a primary transfer voltage and a transfer efficiency due to a difference in surface resistivity of the intermediary transfer belt.

Here, FIG. 13 is a graph showing a relationship between electric field intensity and electrical conductivity of the intermediary transfer belt 7 alone. This graph shows data measured on the basis of a method of measuring a surface resistance in accordance with a JIS K6911 method. As shown in this graph, the electric field intensity and the electrical conductivity of the intermediary transfer belt 7 alone provide a substantially linear proportional relation. For that reason, the intermediary transfer belt 7 alone possesses an electric characteristic such that the current increases relative to the voltage in a quadratic function manner. For that reason, it would be considered that in the image forming apparatus 100, the current-voltage characteristic (IV characteristic) in the case where the voltage not less than the discharge start voltage is applied to the primary transfer portion N1 increases in the quadratic function manner. Incidentally, the relationship between the electric field intensity and the electrical conductivity of the rubber roller provide the proportional relation in many cases, and therefore, even in the case where the rubber roller is used as the primary transfer roller 6, this embodiment is applicable.

Thus, in this embodiment, in the measuring operation, from the primary transfer voltage source E1 to the primary transfer portion N1, a voltage (test voltage) having at least one value at which a current value detected by the detecting portion 32 is less than a predetermined value and voltages having at least three values at which the current value detected by the detecting portion 32 is not less than the predetermined value are applied. Here, the voltage having at least one value at which the current value detected by the detecting portion 32 is a voltage which is smaller than the discharge start voltage between the photosensitive member 1 and the intermediary transfer belt 7 through a set period of the lifetime of the intermediary transfer belt 7. Then, the discharge start voltage is acquired on the basis of the relationship between the current and the voltage in the case where the current value detected by the detecting portion 32 is not less than the predetermined value. Particularly, in this embodiment, in the measuring operation, the absolute value of the voltage applied to the primary transfer portion N1 by the primary transfer voltage source E1 is successively increased, and when the respective voltages are applied, the currents flowing through the primary transfer portion N1 are detected. Further, in this embodiment, at least one value of the values of the voltages applied to the primary transfer portion N1 in the measuring operation is the value of the primary transfer voltage during previous primary transfer. Further, in this embodiment, in the measuring operation, the relationship between the current and the voltage in the case where the current value detected by the detecting portion 32 is not less than the predetermined value is subjected to the approximation with the quadratic function, so that a voltage value in the case where the current value in the relationship between the current and the voltage subjected to the linear approximation is zero is acquired as the discharge start voltage.

As described above, according to this embodiment, even in the case where the detection error of the current detecting portion 32 is large or in the like case, the discharge start voltage is measured further accurately, and on the basis thereof, the primary transfer voltage can be controlled.

Embodiment 4

Next, another embodiment of the present invention will be described. Basic constitutions and operations of an image forming apparatus in this embodiment are the same as those in Embodiment 1. Accordingly, in the image forming apparatus in this embodiment, elements having the same or corresponding functions and constitutions as those in the image forming apparatus in Embodiment 1 are represented by the same reference numerals or symbols and will be omitted from detailed description.

1. Summary of this Embodiment

In the neighborhood of a side upstream of the secondary transfer portion N2 with respect to the rotational direction of the intermediary transfer belt 7), in the case where a gap generates between the toner image carrying surface of the intermediary transfer belt 7 and the recording material P, an image defect which is called a "white flower (white void)" generates in some instances. That is, to the secondary transfer portion N2, the secondary transfer voltage is applied, so that a relatively strong electric field generates, and therefore, in the case where the above-described gap generates, abnormal discharge is liable to generate between the intermediary transfer belt 7 and the recording material P. Further, when the abnormal discharge generates, electric charges of the toner carried on the intermediary transfer belt 7 are lost, so that the toner for which the electric charges are lost is not transferred from the intermediary transfer belt 7 onto the recording material P. As a result, the "white flower" which is an image defect such that the image in a place where the abnormal discharge generated constitutes a white void (hollow portion) generates. This "white flower" is liable to relatively generate in the case where the surface resistivity of the intermediary transfer belt 7 is relatively low, as described specifically later. For that reason, when a lowering in surface resistivity of the intermediary transfer belt 7 can be detected in the image forming apparatus 100, a risk of generation of the "white flower" can be predicted. However, as described above, the conventional method of detecting the electric resistance characteristic of the intermediary transfer belt 7 was not a satisfactory method. Therefore, in this embodiment, the discharge start voltage between the photosensitive member 1 and the intermediary transfer belt 7 is measured similarly as in Embodiment 1 and the surface resistivity of the intermediary transfer belt 7 is acquired, and depending on the acquired surface resistivity, control of changing an upper limit of the secondary transfer voltage is carried out. This will be described specifically below.

2. High-Voltage Capacity of Secondary Transfer Portion

Figure 16:
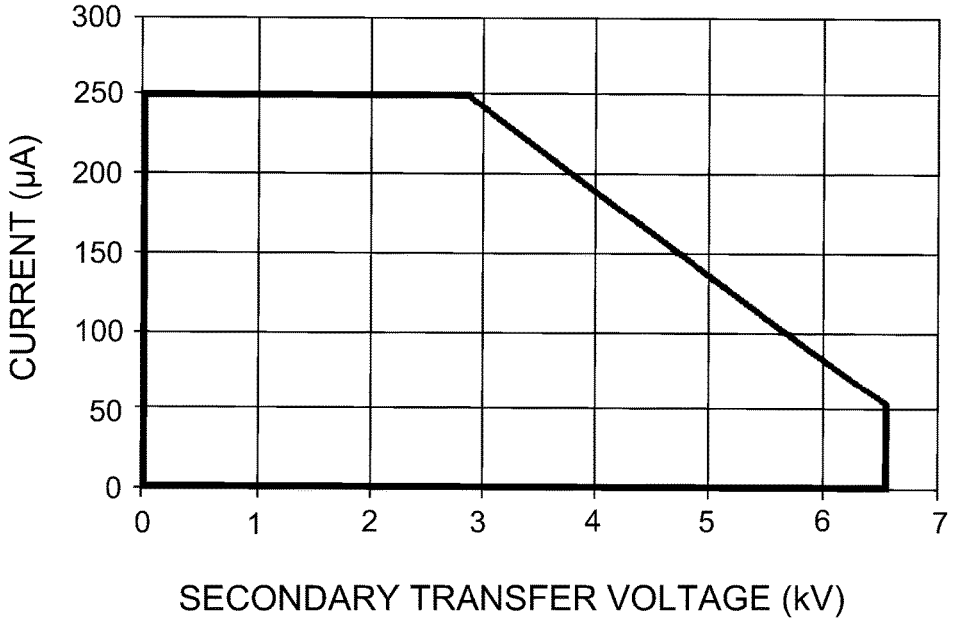
FIG. 16 is a graph showing high-voltage capacity at a secondary transfer portion in Embodiment 4.

FIG. 16 shows high-voltage capacity of the secondary transfer portion N2 in this embodiment. In this embodiment, a secondary transfer voltage up to 6.5 kV is applicable to the secondary transfer portion N2, and during the secondary transfer step, the secondary transfer voltage source E2 outputs the secondary transfer voltage under constant-voltage control. As a result, a transfer current enclosed by a thick line in FIG. 16 can be supplied to the secondary transfer portion N2.

3. Determining Method of Set Voltage of Secondary Transfer Portion

Next, a determining method of a set voltage (target value of secondary transfer voltage (target voltage)) of the secondary transfer portion N2 during the image formation in this embodiment will be described.

Figure 17:
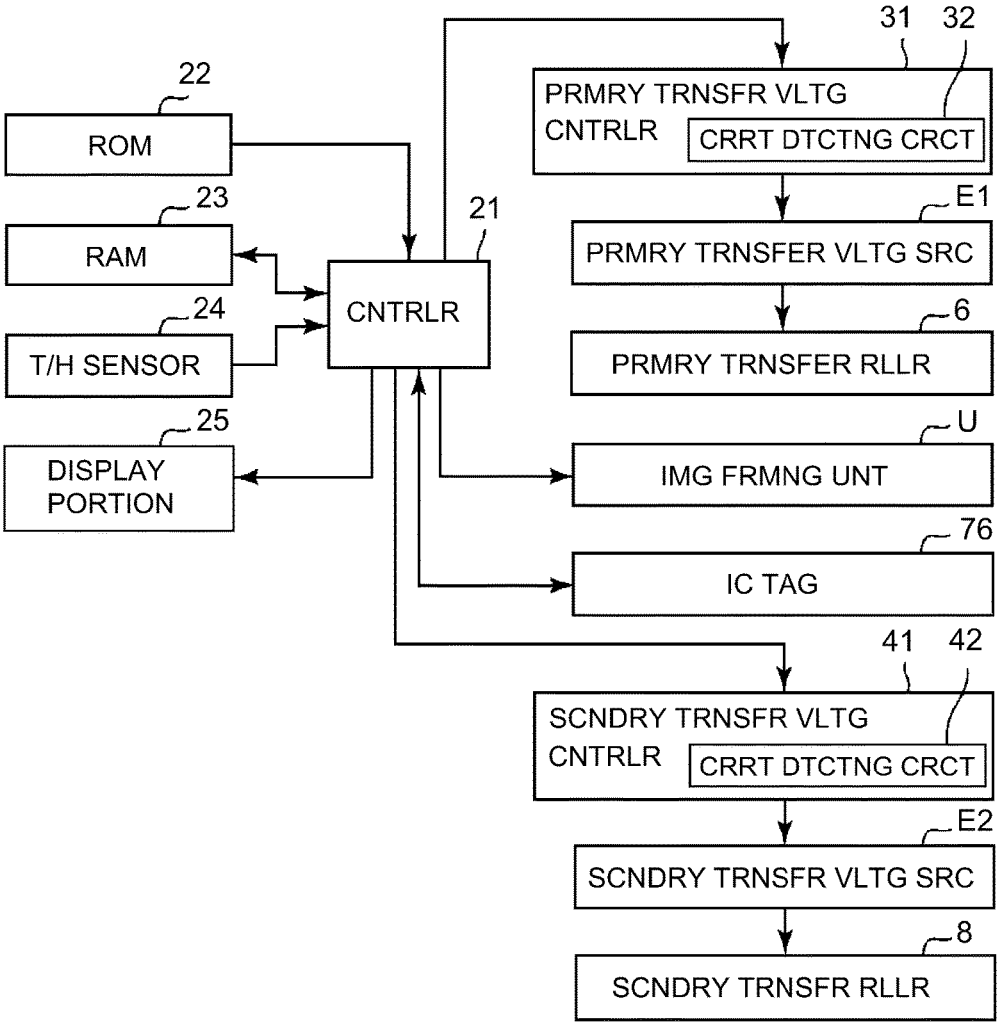
FIG. 17 is a schematic block diagram showing a control mode of a principal part of an image forming apparatus in Embodiment 4.

FIG. 17 is a schematic block diagram showing a control mode of a principal part of the image forming apparatus 100 in this embodiment. To the controller 21, a secondary transfer voltage control circuit 41 is connected. The secondary transfer voltage control circuit 41 controls an operation of the secondary transfer voltage source E2 under control by the controller 21. The secondary transfer voltage source E2 applies the secondary transfer voltage to the secondary transfer portion N2 through the secondary transfer roller 8 and supplies the secondary transfer current to the secondary transfer portion N2. The secondary transfer voltage source E2 is capable of applying, to the secondary transfer roller 8, a voltage having a predetermined value instructed by the secondary transfer voltage control circuit 41 under constant-voltage control. Further, the secondary transfer voltage control circuit 41 includes a current detecting portion (ammeter) 42 for detecting a current flowing through the secondary transfer portion N2 (secondary transfer voltage source E2) by acquiring the voltage from the secondary transfer voltage source E2 to the secondary transfer portion N2. In this embodiment, a target value of the secondary transfer current is set in advance and stored in the ROM 22. Further, the controller 21 determines the set voltage of the secondary transfer portion N2 during the secondary transfer in the following manner by using the target value of the secondary transfer current during the secondary transfer stored in the ROM 22 and information on a sharing voltage depending on the kind of the roller P described later.

A proper secondary transfer electric field varies depending on an ambient condition and the kind of the recording material P. Therefore, in this embodiment, in order to optimize the secondary transfer electric field during transfer of the toner image onto the roller P, the set voltage of the secondary transfer portion N2 during the secondary transfer is determined by an adjusting step which is called ATVC (active transfer voltage control). This adjusting step is executed by the secondary transfer voltage control circuit 41 under control by the controller 21 in a state in which the roller P does not exist at the secondary transfer portion N2 during non-image formation. In this embodiment, the adjusting step is executed in the pre-rotation step in every job. Thus, in this embodiment, the secondary transfer voltage control circuit 41 functions as an executing portion for executing the adjusting step of the secondary transfer voltage.

In the adjusting step, adjusting voltages having a plurality of values subjected to the constant-voltage control are applied from the secondary transfer voltage source E2 to the secondary transfer portion N2, and the current flowing through the secondary transfer portion N2 is detected by the current detecting portion 42 when each of the adjusting voltages having the respective values. The controller 21 calculates a correlation between the voltage and the current. Further, the controller 21 calculates, on the basis of the calculated correlation between the voltage and the current, a voltage Vb for causing the secondary transfer current having a target value Itag, to flow during the secondary transfer, stored in the ROM 22. Further, to the voltage Vb for causing the secondary transfer current having the target value Itag to flow during the secondary transfer, the controller 21 adds a recording material sharing voltage Vp corresponding to the recording material P designated as a recording material used in the job stored in the ROM 22. Then, the controller 21 sets the calculated voltage (Vb+Vp) as a set voltage, of the secondary transfer portion N2, applied under the constant-voltage control during the secondary transfer step subsequent to the adjusting step. As a result, a proper secondary transfer voltage value is set depending on the ambient condition and the kind (thickness or the like) of the recording material P. Further, during the secondary transfer, the secondary transfer voltage is subjected to the constant control, and therefore, even when a width of the recording material P with respect to a direction substantially perpendicular to the feeding direction of the roller P, the secondary transfer is carried out in a stable state.

Further, in the secondary transfer voltage control circuit 41, the upper limit of the set voltage of the secondary transfer portion N2 is held (stored). Then, the controller causes the secondary transfer voltage source to apply, in the case where the set voltage of the state portion N2 during the secondary transfer acquired by executing the adjusting step as described above exceeds the upper limit, the voltage of the upper limit to the secondary transfer portion N2 under the constant-voltage control during the secondary transfer subsequent to the adjusting step.

4. Changing Method of Upper Limit of Set Voltage of Secondary Transfer Portion Next, a changing method of the upper limit of the set voltage of the secondary transfer portion N2 during the secondary transfer will be described.

Figure 18:
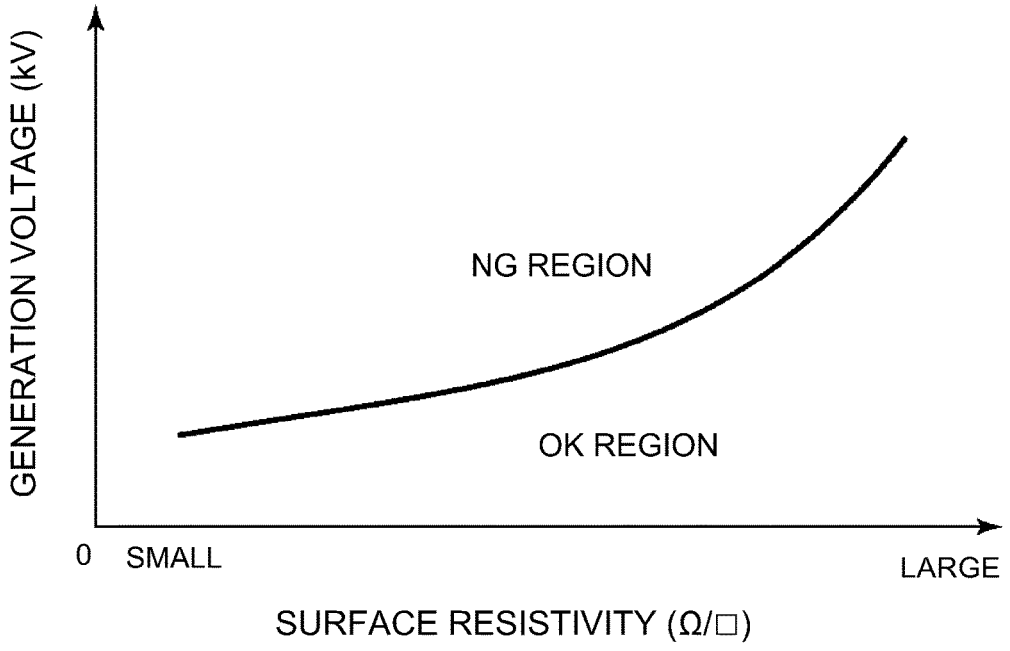
FIG. 18 is a graph showing a relationship between a surface resistivity of an intermediary transfer belt and a secondary transfer voltage at which white flower (void) generates.

FIG. 18 is a graph showing a relationship between the surface resistivity of the intermediary transfer belt 7 and the set voltage of the secondary transfer portion N2 at which the "white flower" generates. As shown in FIG. 18, when the surface resistivity of the intermediary transfer belt 7 lowers, the set voltage of the secondary transfer portion N2 at which the "white flower" generates lowers. This is because when the surface resistivity of the intermediary transfer belt 7 lowers, electric charges easily move toward the upstream side of the secondary transfer portion N2 and thus the abnormal discharge is liable to generate at a lower voltage, applied to the secondary transfer portion N2. Therefore, in this embodiment, depending on the surface resistivity of the intermediary transfer belt 7, an upper limit Vlim of the set voltage of the secondary transfer portion N2 during the image formation is changed.

Table 1 shows a check result of generation and non-generation of the "white flower" in relation to the surface resistivity of the intermediary transfer belt 7 and the upper limit Vlim of the set voltage of the secondary transfer portion N2. In this embodiment, in a low temperature/low humidity environment (23° C./5% RH), a solid image and a half-tone image were formed, and whether or not the "white flower" generated in the image on the recording material P was discriminated by eye observation. A discrimination is shown as "x (poor)" in the case where the "white flower" generated and as "○ (good)" in the case where the "white flower" did not generate.

TABLE 1

| SURFACE RESISTIVITY | Vlim (kV) | | |
|---|---|---|---|
| (Ω/□) | 6.5 | 5.8 | 5.1 |
| $1.00 \times 10^{10}$ | ○ | ○ | ○ |
| $1.00 \times 10^{9}$ | × | ○ | ○ |
| $1.00 \times 10^{8}$ | × | × | ○ |

From the result of Table 1, it is understood that in the case where the surface resistivity is not less than $1\times10^{10}$Ω/□ (in other words, in the case where the surface resistivity is of the order of 10 (raised) to the 10th power), even when Vlim is kept at 6.5 kV as an initial value, the "white flower" is suppressed. Further, it is understood that in the case where the surface resistivity is not less than $1\times10^{9}$ Ω/□ and less than $1\times10^{10}$Ω/□ (in other words, in the case where the surface resistivity is of the order of 10 (raised) to the 9th power), by changing Vlim to 5.8 kV, the "white flower" can be suppressed. Further, it is understood that in the case where the surface resistivity is not less than $1\times10^{8}$ Ω/□ and less than $1\times10^{9}$ Ω/□ (in other words, in the case where the surface resistivity is of the order of 10 (raised) to the 8th power), by changing Vlim to 5.1 kV, the "white flower" can be suppressed.

Figure 19:
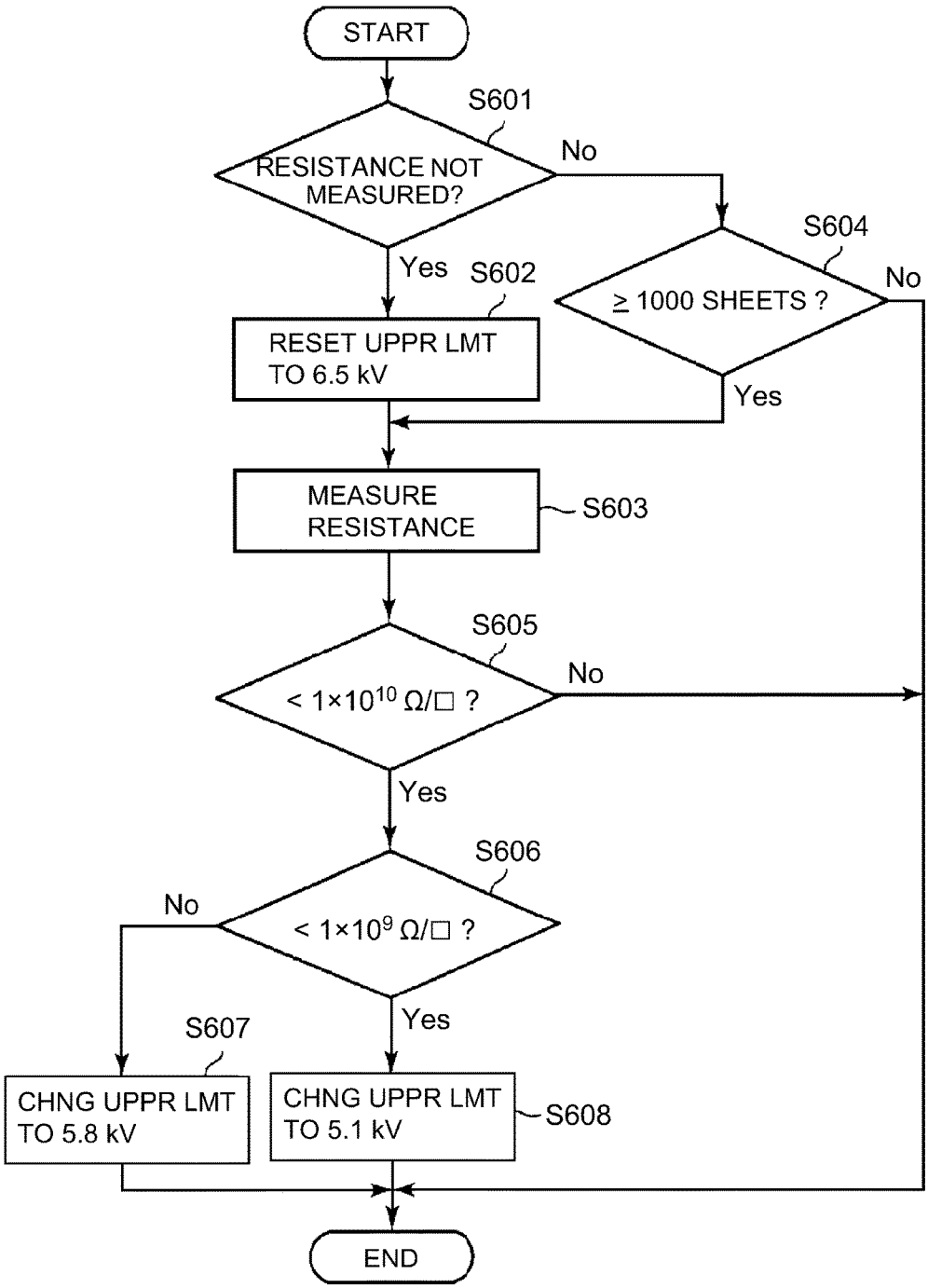
FIG. 19 is a flowchart of control in Embodiment 4.

FIG. 19 is a flowchart of an operation of changing the upper limit Vlim of the set voltage of the secondary transfer portion N2 by performing a resistance measuring operation in this embodiment. In this embodiment, similarly as in Embodiment 1, the resistance measuring operation carried out every printing of a predetermined number of sheets (1000 sheets on an A4-conversion basis in this embodiment. Further, in the case where the intermediary transfer belt 7 is exchanged, the upper limit Vlim of the set voltage of the secondary transfer portion N2 is reset to 6.5 kV which is the initial value.

First, at that time of starting the job or the like time, the controller 21 discriminates whether or not the resistance measuring operation of the intermediary transfer belt 7 used in the printing operation is executed before (S601). Similarly as in Embodiment 1, the controller 21 can discriminate execution or non-execution of the resistance measuring operation by reading the information on the number of times of execution stored in the IC tag 76. In S601, in the case where the controller 21 discriminated that the resistance measuring operation is not executed by inputting information, through the operation display portion 25, the controller 21 resets Vlim, held by the secondary transfer voltage control circuit 41, to 6.5 kV (S602). Then, the controller 21 executes the resistance measuring operation (S603). In this embodiment, the resistance which is the same as that described in Embodiment 1 is executed.

In S601, in the case where discrimination that the resistance measuring operation has been executed is made, the controller 21 discriminates whether or not a cumulative print number in an A4 conversion basis from the last resistance measuring operation is 1000 sheets or more (S604). In S604, discrimination that the print number is not less than 1000 sheets is made, the controller 21 executes the resistance measuring operation (S603). In S604, in the case where discrimination that the print number is not 1000 sheets or more is made, the controller 21 ends the process.

In S603, the resistance measuring operation is executed, and thereafter, the controller 21 discriminates whether or not the surface resistivity of the intermediary transfer belt 7 is less than $1\times10^{10}$Ω/□ on the basis of a result of the resistance measuring operation (S605), In S605, in the case where the controller 21 discriminated that the surface resistivity of the intermediary transfer belt 7 is not less than $1\times10^{10}$Ω/□ (i.e., $1\times10^{10}$Ω/□ or more), the controller 21 does not make the change of Vlim and ends the process. In S605, in the case where the controller 21 discriminates that the surface resistivity of the intermediary transfer belt 7 is less than $1\times10^{10}$Ω/□, the controller 21 discriminates whether or not the surface resistivity of the intermediary transfer belt 7 is less than $1\times10^{9}$ Ω/□ (S606). In S606, in the case where the controller 21 discriminated that the surface resistivity of the intermediary transfer belt 7 is not less than $1\times10^{9}$ Ω/□ (i.e., $1\times10^9$ Ω/□ or ore and less than $1\times10^{10}$Ω/□), the controller 21 changes Vlim from 6.5 kV to 5.8 kV (S607) and ends the process. On the other hand, in S606, in the case where the controller 21 discriminated that the surface resistivity of the intermediary transfer belt 7 is less than $1\times10^9$ Ω/□ (i.e., $1\times10^8$ Ω/□ or ore and less than $1\times10^9$ Ω/□), the controller 21 changes Vlim from 5.8 kV to 5.1 kV (S608) and ends the process.

Thus, in this embodiment, on the basis of the discharge start voltage acquired by executing the measuring operation, the controller 21 changes the upper limit of the secondary transfer voltage applied during the secondary transfer from the secondary transfer voltage source E2 to the secondary transfer portion N2. Particularly, in this embodiment, the controller 21 acquires the surface resistivity of the intermediary transfer belt 7 on the basis of the discharge start voltage and changes the upper limit of the secondary transfer voltage on the basis of the acquired surface resistivity. At this time, the controller 21 changes the upper limit of the secondary transfer voltage so that an absolute value of the upper limit of the secondary transfer voltage in the case where an absolute value of the discharge start voltage is a second value smaller than a first value is made smaller than an absolute value of the upper limit of the secondary transfer voltage in the case where the absolute value of the discharge start voltage is the first value.

As described above, according to this embodiment, in the constitution which is simple and advantageous in terms of downsizing and cost reduction, by determining the upper limit of the secondary transfer voltage depending on the electric resistance characteristic (surface resistivity) of the intermediary transfer belt 7, the generation of the "white flower" can be suppressed.

Incidentally, in this embodiment, the discrimination control of the execution of the resistance measuring operation similar to that in Embodiment 2 may also be carried out, and the resistance measuring operation similar to those in Embodiments 2 and 3 may also be executed.

Embodiment 5

Next, another embodiment of the present invention will be described. Basic constitutions and operations of an image forming apparatus in this embodiment are the same as those in Embodiment 1. Accordingly, in the image forming apparatus in this embodiment, elements having the same or corresponding functions and constitutions as those in the image forming apparatus in Embodiment 1 are represented by the same reference numerals or symbols and will be omitted from detailed description.

1. Summary of this Embodiment

In Embodiment 4, the upper limit Vlim of the set voltage of the secondary transfer portion N2 was changed at timing when the surface resistivity (Ω/□) of the intermediary transfer belt 7 lowers to the order of $10^9$ and the order of $10^8$. On the other hand, also by narrowing a gap between the intermediary transfer belt 7 and the recording material P in the upstream side of the secondary transfer portion N2 by changing a feeding speed of the recording material P to the secondary transfer portion N2 by the registration roller pair 9 for feeding the recording material P to the secondary transfer portion N2, a "white flower" suppressing effect is achieved.

Figure 20:
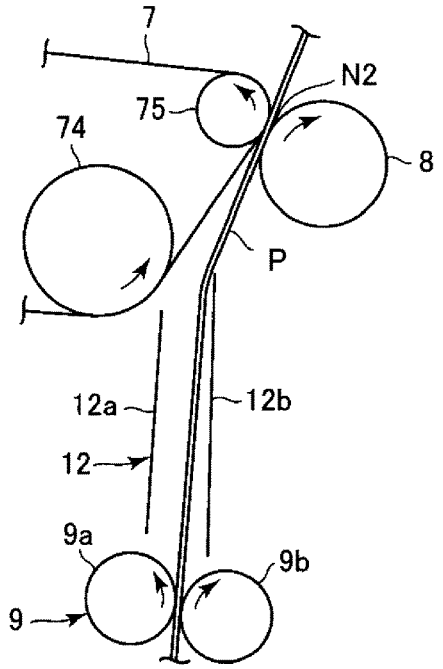
In FIG. 20, (a) and (b) are schematic sectional views showing a feeding state of a recording material in the neighborhood of a secondary transfer portion.
Figure 20:
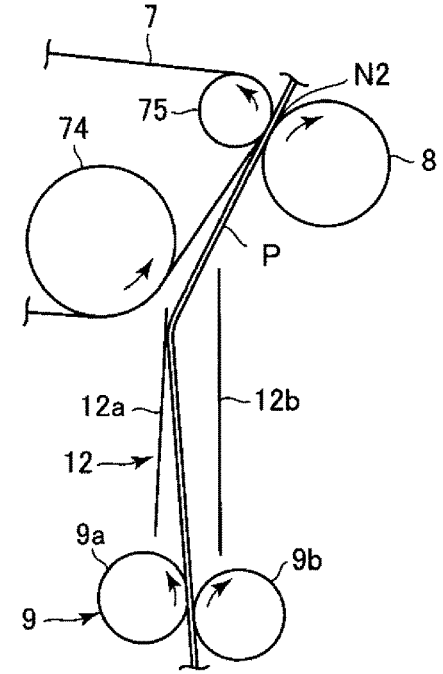

In FIG. 20, (a) and (b) are schematic sectional views each showing a feeding state of the recording material P in the neighborhood of the secondary transfer portion N2. In this embodiment, the intermediary transfer belt 7 is stretched by a plurality of stretching rollers including the secondary transfer opposite roller 75 as a first stretching roller and the second idler roller 74 as a second stretching roller. The second idler roller 74 is the stretching roller disposed adjacent to the secondary transfer opposite roller 75 in a side upstream of the secondary transfer opposite roller 75 with respect to the rotational direction of the intermediary transfer belt 7. Further, the secondary transfer roller 8 contacts the intermediary transfer belt 7 toward the secondary transfer opposite roller 75 and forms the secondary transfer portion N2. Further, in a side upstream of the secondary transfer portion N2 with respect to the feeding direction of the recording material P, as a guiding member, a feeding guide pair 12 consisting of first and second feeding guides 12*a* and 12*b* is provided. The first feeding guide 12*a* is provided so as to be contactable to a print surface of the recording material P on which the toner image is transferred immediately after the recording material P passes through the first feeding guide 12*a*, and the second feeding guide 12*b* is provided so as to be contactable to a non-print surface opposite from the print surface of the recording material P. Further, in a side upstream of the feeding guide pair 12 with respect to the feeding direction of the recording material P, the registration roller pair 9 consisting of first and second registration rollers 9*a* and 9*b* as feeding means is disposed. The recording material P is fed by the registration roller pair 9 to the secondary transfer portion N2 along the intermediary transfer belt (member) 7 stretched between the secondary transfer opposite roller 75 and the second idler roller 74 while being guided by the feeding guide pair 12.

At this time, for example, in the case where the feeding speed of the recording material P by the registration roller pair 9 and the feeding speed of the intermediary transfer belt 7 is substantially equal to each other, as shown in (a) of FIG. 20, there is a tendency that the gap between the intermediary transfer belt 7 and the recording material P in the side upstream of the secondary transfer portion N2 becomes relatively large. Incidentally, the feeding speed of the intermediary transfer belt 7 is substantially equal to the feeding speed of the recording material P at the secondary transfer portion N2. On the other hand, in the case where the feeding speed of the recording material P by the registration roller pair 9 is larger than the feeding speed of the intermediary transfer belt 7, as shown in (b) of FIG. 20, the recording material P form a loop between the secondary transfer portion N2 and the feeding guide pair 12. In this case, in this embodiment, depending on structures and positions of the feeding guide pair 12 and the registration roller pair 9, the gap between the intermediary transfer belt 7 and the recording material P in the side upstream of the secondary transfer portion N2 has a tendency to become smaller than that in the case of (a) of FIG. 20. Thus, by decreasing the gap between the intermediary transfer belt 7 and the recording material P in the side upstream of the secondary transfer portion N2, it is possible to suppress the generation of the abnormal discharge such that the "white flower" is generated.

Therefore, in this embodiment, the "white flower" is suppressed by combining a change in upper limit Vlim of the set voltage of the secondary transfer portion N2 with a change in feeding speed Vreg of the recording material P by the registration roller pair 9. As a result, it becomes possible to suppress a change amount of the upper limit Vlim of the set voltage of the secondary transfer portion N2 more than Embodiment 4.

Incidentally, as regards the feeding speed Vreg of the recording material P by the registration roller pair 9, the feeding speed (peripheral speed) of the intermediary transfer belt 7 is defined as 100%, and the feeding speed Vreg is represented by % (percentage) of the speed to the feeding speed of the intermediary transfer belt 7. In this embodiment, an initial value of the feeding speed Vreg of the recording material P by the registration roller pair 9 is 102% and is larger than the feeding speed of the intermediary transfer belt 7.

Figure 21:
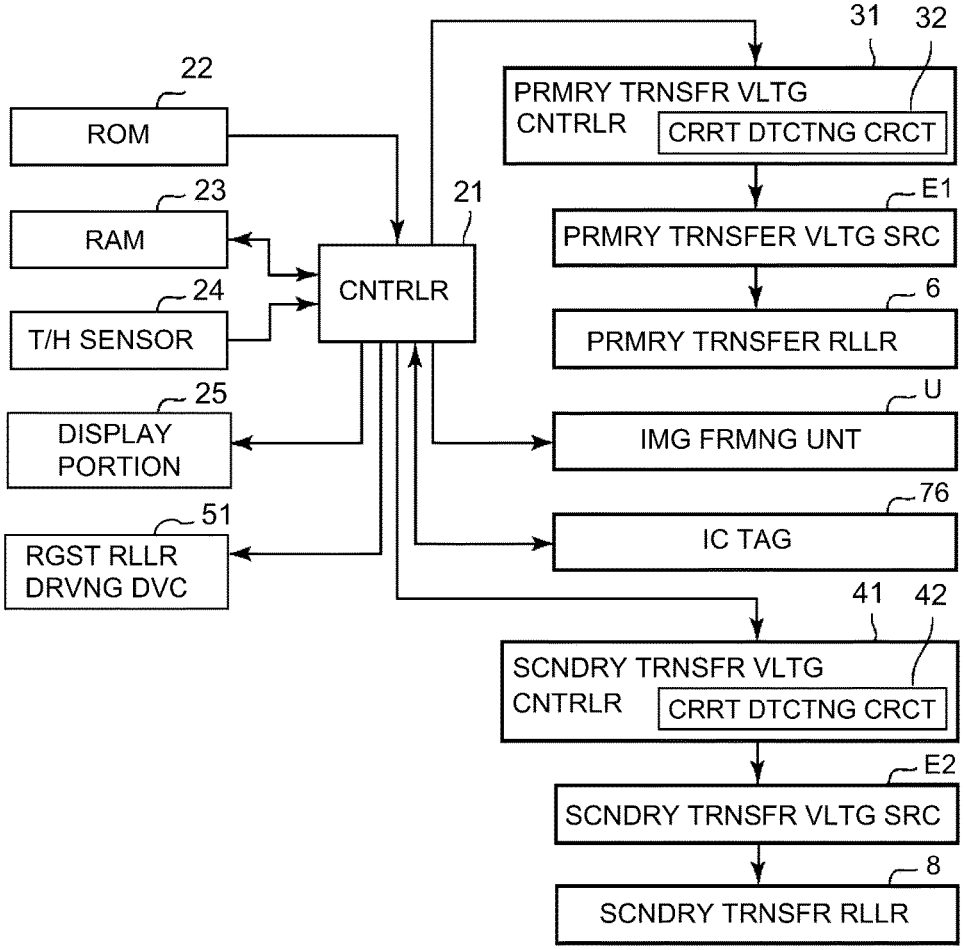
FIG. 21 is a schematic block diagram showing a control mode of a principal part of an image forming apparatus in Embodiment 5.

2. Changing Method of Feeding Speed of Recording Material by Registration Roller Pair FIG. 21 is a block diagram showing a control mode of a principal portion of the image forming apparatus 100 in this embodiment. To the controller 21, a registration roller driving device 51 is connected. The registration roller driving device 51 is constituted by including a driving source, a control circuit for controlling a rotational speed of a driving shaft of the driving source, and a drive transmitting member for transmitting a driving force from the driving source to the registration roller pair 9 (at least one of the registration rollers 9*a* and 9*b*), and the like. The registration roller driving device 51 effects control, under control of the controller 21, of ON/OFF of the drive of the registration roller pair 9 and driving speed (feeding speed of the recording material P by the registration roller pair 9).

Table 2 shows a check result of generation and non-generation of the "white flower" in relation to the surface resistivity of the intermediary transfer belt 7, the upper limit Vlim of the set voltage of the secondary transfer portion N2 and the feeding speed Vreg of the recording material P by the registration roller pair 9. In this embodiment, in a low temperature/low humidity environment (23° C./5% RH), a solid image and a half-tone image were formed, and whether or not the "white flower" generated in the image on the recording material P was discriminated by eye observation. A discrimination is shown as "x (poor)" in the case where the "white flower" generated and as "○ (good)" in the case where the "white flower" did not generate.

TABLE 2

| SURFACE RESISTIVITY | Vlim (kV)/Vreg (%) | | |
|---|---|---|---|
| (Ω/□) | 6.5/102 | 6.2/104 | 5.9/104 |
| $1.00 \times 10^{10}$ | ○ | ○ | ○ |
| $1.00 \times 10^{9}$ | × | ○ | ○ |
| $1.00 \times 10^{8}$ | × | × | ○ |

From the result of Table 2, it is understood that in the case where the surface resistivity is not less than $1\times10^{10}$Ω/□ (in other words, in the case where the surface resistivity is of the order of 10 (raised) to the 10th power), even when Vlim is kept at 6.5 kV as an initial value and Vreg is kept at 102% as an initial value, the "white flower" is suppressed. Further, it is understood that in the case where the surface resistivity is not less than $1\times10^{9}$ Ω/□ and less than $1\times10^{10}$Ω/□ (in other words, in the case where the surface resistivity is of the order of 10 (raised) to the 9th power), by changing Vlim to 6.2 kV and changing Vreg to 104%, the "white flower" can be suppressed. Further, it is understood that in the case where the surface resistivity is not less than $1\times10^{8}$ Ω/□ and less than $1\times10^{9}$ Ω/□ (in other words, in the case where the surface resistivity is of the order of 10 (raised) to the 8th power), by changing Vlim to 5.9 kV and changing Vreg to 104%, the "white flower" can be suppressed.

Figure 22:
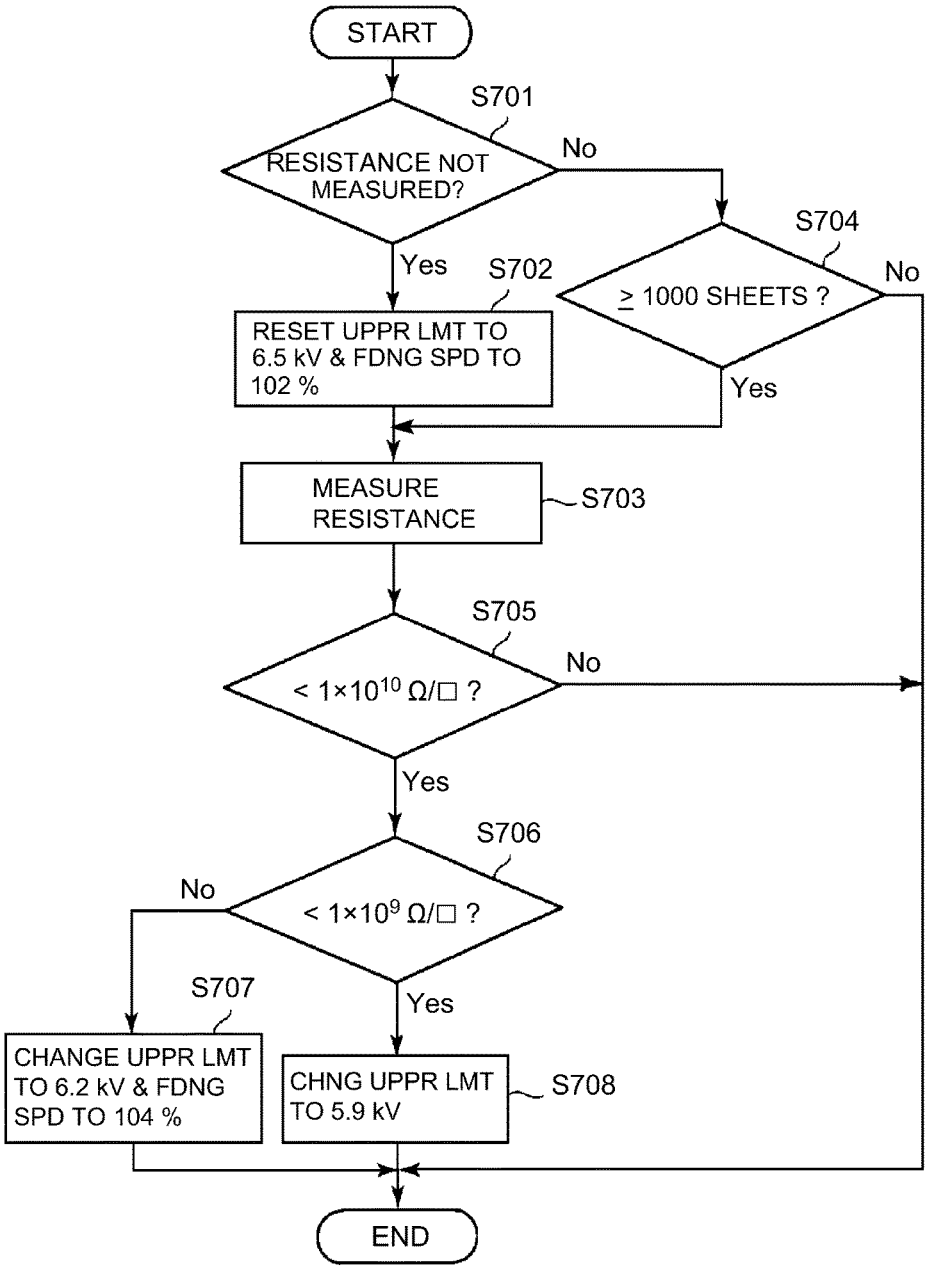
FIG. 22 is a flowchart of control in Embodiment 5.

FIG. 22 is a flowchart of an operation of changing the upper limit Vlim of the set voltage of the secondary transfer portion N2 and changing the feeding speed Vreg of the recording material P by the registration roller pair 9 by performing a resistance measuring operation in this embodiment. In this embodiment, similarly as in Embodiment 1, the resistance measuring operation carried out every printing of a predetermined number of sheets (1000 sheets on an A4-conversion basis in this embodiment. Further, in the case where the intermediary transfer belt 7 is exchanged, the upper limit Vlim of the set voltage of the secondary transfer portion N2 is reset to 6.5 kV which is the initial value, and the feeding speed Vreg of the recording material P by the registration roller pair 9 is reset to 102% which is the initial value.

First, at that time of starting the job or the like time, the controller 21 discriminates whether or not the resistance measuring operation of the intermediary transfer belt 7 used in the printing operation is executed before (S701). Similarly as in Embodiment 1, the controller 21 can discriminate execution or non-execution of the resistance measuring operation by reading the information on the number of times of execution stored in the IC tag 76. In S701, in the case where the controller 21 discriminated that the resistance measuring operation is not executed by inputting information, through the operation display portion 25, the controller 21 resets Vlim, held by the secondary transfer voltage control circuit 41, to 6.5 kV and resets Vreg, held by the registration roller driving device 51, to 102% (S702). Then, the controller 21 executes the resistance measuring operation (S703). In this embodiment, the resistance which is the same as that described in Embodiment 1 is executed.

In S701, in the case where discrimination that the resistance measuring operation has been executed is made, the controller 21 discriminates whether or not a cumulative print number in an A4 conversion basis from the last resistance measuring operation is 1000 sheets or more (S704). In S704, discrimination that the print number is not less than 1000 sheets is made, the controller 21 executes the resistance measuring operation (S703). In S704, in the case where discrimination that the print number is not 1000 sheets or more is made, the controller 21 ends the process.

In S703, the resistance measuring operation is executed, and thereafter, the controller 21 discriminates whether or not the surface resistivity of the intermediary transfer belt 7 is less than $1\times10^{10}$Ω/□ on the basis of a result of the resistance measuring operation (S705), In S705, in the case where the controller 21 discriminated that the surface resistivity of the intermediary transfer belt 7 is not less than $1\times10^{10}$Ω/□ (i.e., $1\times10^{10}$Ω/□ or more), the controller 21 does not make the changes of Vlim and Vreg and ends the process. In S705, in the case where the controller 21 discriminates that the surface resistivity of the intermediary transfer belt 7 is less than $1\times10^{10}$Ω/□, the controller 21 discriminates whether or not the surface resistivity of the intermediary transfer belt 7 is less than $1\times10^{9}$ Ω/□ (S706). In S706, in the case where the controller 21 discriminated that the surface resistivity of the intermediary transfer belt 7 is not less than $1\times10^{9}$ Ω/□ (i.e., $1\times10^{9}$ Ω/□ or ore and less than $1\times10^{1\circ}$ Ω/□), the controller 21 performs the following operation. That is, the controller 21 changes Vlim from 6.5 kV to 6.2 kV and changes Vreg from 102% to 104% (S707) and ends the process. On the other hand, in S706, in the case where the controller 21 discriminated that the surface resistivity of the intermediary transfer belt 7 is less than $1\times10^{9}$ Ω/□ (i.e., $1\times10^8$ Ω/□ or ore and less than $1\times10^9$ Ω/□), the controller 21 performs the following operation. That is, the controller 21 changes only Vlim from 6.2 kV to 5.9 kV (S708) and ends the process.

Thus, in this embodiment, on the basis of the discharge start voltage acquired by executing the measuring operation in addition to the change in upper limit of the secondary transfer voltage, the controller 21 changes the feeding speed of the recording material P fed to the secondary transfer portion N2 by the feeding means. Particularly, in this embodiment, the controller 21 acquires the surface resistivity of the intermediary transfer belt 7 on the basis of the discharge start voltage and changes the feeding speed on the basis of the acquired surface resistivity. At this time, the controller 21 changes the feeding speed so that the feeding speed in the case where an absolute value of the discharge start voltage is a fourth value smaller than a third value is made smaller than feeding speed in the case where the absolute value of the discharge start voltage is the third value.

As described above, according to this embodiment, not only an effect similar to that of Embodiment 4 can be obtained but also an optimum secondary transfer current can be supplied to the extent possible by suppressing the change amount of the upper limit of the set voltage of the secondary transfer portion N2.

Incidentally, in this embodiment, the discrimination control of the execution of the resistance measuring operation similar to that in Embodiment 2 may also be carried out, and the resistance measuring operation similar to those in Embodiments 2 and 3 may also be executed.

Further, in this embodiment, the change in Vlim and the change in Vreg are combined, but only by the change in Vreg which is the feeding speed of the recording material P by the registration roller pair 9, a corresponding effect of suppressing the "white flower" can be obtained.

Other Embodiments

The present invention was described based on the specific embodiments mentioned above, but is not limited to the above-mentioned embodiments.

In the above-described embodiments, the case where the resistance measuring operation was executed at one primary transfer portion was described, but the resistance measuring operation may also be executed at a plurality of primary transfer portions as desired. In that case, on the basis of a result (discharge start voltage and surface resistivity) of the resistance measuring operation executed at the plurality of primary transfer portions (for example, on the basis of an average thereof), primary transfer voltages at a plurality (e.g., all) of the primary transfer portions can be controlled. Or, on the basis of the result of the resistance measuring operation executed at each of the primary transfer portions, the primary transfer voltage at the associated primary transfer portion may also be controlled.

Further, the image forming apparatus is capable of executing a full-color mode and a monochromatic (white/black) mode and is constituted in some instances so that the intermediary transfer belt contacts all of the photosensitive members in the full-color mode and the intermediary transfer belt contacts only the recording material for black in the monochromatic mode. In such an image forming apparatus, in the case where the resistance measuring operation is performed at a single primary transfer portion, the resistance measuring operation can be executed at the primary transfer portion for black in a state in which the intermediary transfer belt is contacted to only the photosensitive member for black (in this state, other photosensitive members may be at rest). As a result, it is possible to reduce a degree of abrasion of the photosensitive members and the intermediary transfer belt due to execution of the resistance measuring operation.

Further, in the above-described embodiments, for easy understanding of the present invention, the target value of the primary transfer current was described by paying attention to adjustment thereof by the surface resistance of the intermediary transfer belt acquired by the resistance measuring operation. As is well known by a person skilled in the art, the target value of the primary transfer current is adjusted in some instances also depending on another condition such as an environment. The present invention is applicable to also that case, and on the basis of the result of the resistance measuring operation in addition to or in place of the above-described another condition, the target value of the primary transfer current can be adjusted. The adjustment of making the target value of the primary transfer current, in the case where the absolute value of the discharge start voltage is the second value smaller than the first value, smaller than the target value of the primary transfer current in the case where the absolute value of the discharge start voltage is the first value refers to that made by comparison in the case where another condition is substantially the same.

Further, the primary transfer voltage applied to the primary transfer portion during the primary transfer step may also be subjected to the constant-current control or the constant-voltage control. In the case where the primary transfer voltage is subjected to the constant-current control, an output voltage value of the primary transfer voltage source may only be required to be controlled so that the current flowing through the primary transfer portion during the primary transfer step is the target value of the primary transfer current. In the case where the primary transfer voltage is subjected to the constant-voltage control, a voltage value for supplying the target primary transfer current to the primary transfer portion is acquired during non-image formation (such as during the pre-rotation step), and during the primary transfer step, the voltage subjected to the constant-voltage control with the voltage value may only be required to be outputted from the primary transfer voltage source.

Further, the primary transfer voltage is not limited to that controlled by setting the target value of the current, but may also be controlled by setting the target value of the voltage, for example, in the case where the primary transfer voltage is subjected to the constant-voltage control during the primary transfer step. Further, the secondary transfer voltage is not limited to that subjected to the constant-voltage control, but can also be subjected to the constant-current control so that the target secondary transfer current flows. Also in this case, the upper limit of the voltage outputted by the secondary transfer voltage source can be set.

Further, in the above-described embodiments, the surface resistivity of the intermediary transfer belt was acquired from the discharge start voltage measured by the resistance measuring operation, and on the basis of the surface resistivity, the primary transfer voltage was controlled. However, the primary transfer voltage is not limited thereto, but may also be directly controlled from the discharge start voltage measured by the resistance measuring operation. In that case, information indicating a relationship between the discharge start voltage and a target control value of the primary transfer voltage is acquired in advance, and that target control value of the primary transfer voltage may only be required to be adjusted (determined) from the discharge start voltage measured by the resistance measuring operation. Further, in the above-described embodiments, the surface resistivity of the intermediary transfer belt was acquired from the discharge start voltage measured by the resistance measuring operation, and on the basis of the surface resistivity, the upper limit of the secondary transfer voltage or the feeding speed of the recording material by the registration roller pair was changed. However, the present invention is not limited thereto, but the upper limit of the secondary transfer voltage or the feeding speed of the roller by the registration roller pair may also be directly determined from the discharge start voltage measured by the resistance measuring operation. In that case, information indicating a relationship between the discharge start voltage and the upper limit of the secondary transfer voltage or the feeding speed of the recording material is acquired in advance, and the upper limit of the secondary transfer voltage or the feeding speed of the recording material may only be required to be determined from the discharge start voltage measured by the resistance measuring operation.

Further, in the above-described embodiments, the primary transfer member was the roller-shaped member, but is not limited thereto, and may also have other shapes (forms) such as a blade shape, a brush shape and a film shape.

Further, in the above-described embodiments, the intermediary transfer member was the endless belt stretched by the plurality of stretching rollers, but is not limited thereto, and may also have, for example, other forms such as a film which is stretched around a frame in a drum shape.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2016-099854 filed on May 18, 2016 and 2017-039692 filed on Mar. 2, 2017, which are hereby incorporated by reference herein in their entirety.

What is claimed is:

1. An image forming apparatus comprising:

an image bearing member configured to bear a toner image;

an intermediary transfer belt configured to temporarily carry the toner image which is primary-transferred from said image bearing member at a primary transfer portion and which is then to be secondary-transferred onto a recording material;

a primary transfer roller configured to form the primary transfer portion in contact with said intermediary transfer belt, said primary transfer roller being provided so that a contact region between said primary transfer roller and said intermediary transfer belt and a contact region between said image bearing member and said intermediary transfer belt are in a non-overlapping state with each other with respect to a movement direction of said intermediary transfer belt;

a primary transfer voltage source configured to apply a voltage to said primary transfer roller;

a detecting portion configured to detect a current flowing through the primary transfer portion;

an executing portion configured to acquire information on a discharge start voltage on the basis of a detection result of said detecting portion in a non-primary-transfer period by applying the voltage to said primary transfer roller by said primary transfer voltage source; and a setting portion configured to set, on the basis of an execution result of said executing portion, a primary transfer voltage applied to said primary transfer roller by said primary transfer voltage source in the period of the primary transfer.

2. An image forming apparatus according to claim 1, wherein said primary transfer roller is a roller made of metal.

3. An image forming apparatus according to claim 1, wherein said setting portion sets, on the basis of an execution result of said executing portion, a target value of a primary transfer current supplied to said primary transfer roller in the period of the primary transfer.

4. An image forming apparatus according to claim 3, wherein said setting portion sets the target value of the primary transfer current so as to be smaller when an absolute value of the information is a second value smaller than a first value than when the absolute value of the information is the first value.

5. An image forming apparatus according to claim 1, wherein said executing portion applies a plurality of biases to said primary transfer roller in the non-primary-transfer period thereby to cause currents to flow through the primary transfer portion, and acquires the information on the basis of the bias such that the current flowing through the primary transfer portion when the bias is applied to said primary transfer roller is not less than a predetermined threshold.

6. An image forming apparatus comprising:

an image bearing member configured to bear a toner image;

an intermediary transfer belt configured to temporarily carry the toner image which is primary-transferred from said image bearing member at a primary transfer portion and which is then to be secondary-transferred onto a recording material at a secondary transfer portion;

a primary transfer roller configured to form the primary transfer portion in contact with said intermediary transfer belt, said primary transfer roller being provided so that a contact region between said primary transfer roller and said intermediary transfer belt and a contact region between said image bearing member and said intermediary transfer belt are in a non-overlapping state with each other with respect to a movement direction of said intermediary transfer belt;

a primary transfer voltage source configured to apply a voltage to said primary transfer roller;

a detecting portion configured to detect a current flowing through the primary transfer portion;

a secondary transfer voltage source configured to apply a voltage to the secondary transfer portion;

an executing portion configured to acquire information on a discharge start voltage on the basis of a detection result of said detecting portion in a non-primary-transfer period by applying the voltage to said primary transfer roller by said primary transfer voltage source; and a changing portion configured to change, on the basis of an execution result of said executing portion, an upper limit of a secondary transfer voltage applied to the secondary transfer portion by said secondary transfer voltage source in a period of secondary transfer.

7. An image forming apparatus according to claim 6, wherein said primary transfer roller is a roller made of metal.

8. An image forming apparatus according to claim 6, wherein said changing portion changes the upper limit of the secondary transfer voltage so as to be smaller when an absolute value of the information is a second value smaller than a first value than when the absolute value of the information is the first value.

9. An image forming apparatus according to claim 6, further comprising a feeding member configured to feed the recording material to the secondary transfer portion, wherein said changing portion changes, on the basis of the information, a feeding speed of the recording material fed to the secondary transfer portion by said feeding member.

10. An image forming apparatus according to claim 9, wherein said changing portion changes the feeding speed so as to be higher when an absolute value of the information is a second value smaller than a first value than when the absolute value of the information is the first value.

11. An image forming apparatus according to claim 6, wherein said executing portion applies a plurality of biases to said primary transfer roller in the non-primary-transfer period thereby to cause currents to flow through the primary transfer portion, and acquires the information on the basis of the bias such that the current flowing through the primary transfer portion when the bias is applied to said primary transfer roller is not less than a predetermined threshold.

12. An image forming apparatus comprising:

an image bearing member configured to bear a toner image;

an intermediary transfer belt configured to temporarily carry the toner image which is primary-transferred from said image bearing member at a primary transfer portion and which is then to be secondary-transferred onto a recording material at a secondary transfer portion;

a primary transfer roller configured to form the primary transfer portion in contact with said intermediary transfer belt, said primary transfer roller being provided so that a contact region between said primary transfer roller and said intermediary transfer belt and a contact region between said image bearing member and said intermediary transfer belt are in a non-overlapping state with each other with respect to a movement direction of said intermediary transfer belt;

a primary transfer voltage source configured to apply a voltage to said primary transfer roller;

a detecting portion configured to detect a current flowing through the primary transfer portion;

a feeding member configured to feed the recording material to the secondary transfer portion;

an executing portion configured to acquire information on a discharge start voltage on the basis of a detection result of said detecting portion in a non-primary-transfer period y applying the voltage to said primary transfer roller by said primary transfer voltage source; and a changing portion configured to change, on the basis of an execution result of said executing portion, a feeding speed of the recording material fed to the secondary transfer portion by said feeding member.

13. An image forming apparatus according to claim 12, wherein said primary transfer roller is a roller made of metal.

14. An image forming apparatus according to claim 12, wherein said changing portion changes the feeding speed of the recording material so as to be higher when an absolute value of the information is a second value smaller than a first value than when the absolute value of the information is the first value.

* * * * *